United States Patent [19]

Kishimoto et al.

[11] Patent Number: 4,780,403

[45] Date of Patent: Oct. 25, 1988

[54] SILVER HALIDE COLOR PHOTOGRAPHIC MATERIAL CONTAINING DISULFIDE TYPE BLEACH ACCELERATOR

[75] Inventors: Shinzo Kishimoto; Keiji Mihayashi, both of Kanagawa, Japan

[73] Assignee: Fuji Photo Film Co., Ltd., Kanagawa, Japan

[21] Appl. No.: 940,375

[22] Filed: Dec. 11, 1986

[30] Foreign Application Priority Data

Dec. 11, 1985 [JP] Japan ..... 60-278578

[51] Int. Cl.[4] ..... G03C 1/02; G03C 7/00; G03C 5/38; G03C 5/44

[52] U.S. Cl. ..... 430/567; 430/393; 430/430; 430/431; 430/460; 430/461; 430/564; 430/566

[58] Field of Search ..... 430/393, 566, 567, 430, 430/431, 564, 460, 461

[56] References Cited

U.S. PATENT DOCUMENTS

| | | | |
|---|---|---|---|
| 3,241,966 | 3/1966 | Heilmann et al. | 430/393 |
| 4,508,816 | 4/1985 | Yamamuro et al. | 430/393 |
| 4,546,070 | 10/1985 | Kishimoto et al. | 430/430 X |
| 4,594,317 | 6/1986 | Sasaki et al. | 430/567 X |
| 4,621,047 | 11/1986 | Kishimoto et al. | 430/430 X |

*Primary Examiner*—Mukund J. Shah

*Attorney, Agent, or Firm*—Sughrue, Mion, Zinn, Macpeak & Seas

[57] ABSTRACT

A silver halide color photographic material comprising a support having thereon at least one photographic emulsion layer containing tabular silver halide grains having an average aspect ratio of 5 or more and the silver halide color photographic material containing at least one compound represented by formula (I)

(I)

wherein $R_1$ and $R_2$ each represents a hydrogen atom, an alkyl group or an acyl group provided that both $R_1$ and $R_2$ do not represent hydrogen atoms at the same time, or $R_1$ and $R_2$ form a ring; and r represents an integer of from 1 to 3.

The silver halide color photographic material can be bleached in a short period of time using a bleaching agent having a weak bleaching ability which meets requirements of preventing environmental pollution.

A method for processing the silver halide color photographic material by subjecting to color development, then to treatment with a bath having a bleaching ability is also disclosed.

23 Claims, No Drawings

SILVER HALIDE COLOR PHOTOGRAPHIC MATERIAL CONTAINING DISULFIDE TYPE BLEACH ACCELERATOR

FIELD OF THE INVENTION

The present invention relates to a method for processing an exposed silver halide color photographic material (hereinafter referred to as a color light-sensitive material) which comprises developing, bleaching, and fixing (hereinafter referred to as a color photographic processing method), and, more particularly, to an improved bleaching process which accelerates the bleaching function, thus shortening the processing time while providing sufficient bleaching, and providing a color photographic image of good image quality.

BACKGROUND OF THE INVENTION

The fundamental steps of processing color light-sensitive materials generally include a color developing step and a desilvering step. Thus, an exposed color light-sensitive material is subjected to a color developing step, where silver halide is reduced with a color developing agent to produce silver and the oxidation product of color developing agent, which in turn reacts with a color former to yield a dye image. Subsequently, the color light-sensitive material is introduced into a desilvering step, where silver produced in the preceding step is oxidized with an oxidizing agent (usually called a bleaching agent), and dissolved away with a silver ion complexing agent (usually called a fixing agent). Therefore, only a dye image remains in the thus processed color light-sensitive material. In addition to the above-described two fundamental steps of color development and desilveration, actual development processing generally involves auxiliary steps for maintaining the photographic and physical quality of the resulting image, and for improving the preservability of the image. For example, a hardening bath may be used for preventing a light-sensitive layer from being excessively softened during color photographic processing, a stopping bath may be used for effectively stopping the developing reaction, an image stabilizing bath may be used for stabilizing the image, and a layer removing may be used for removing a backing layer on the support.

The above-described desilvering step may be conducted in two ways: one way uses two steps employing a bleaching bath and a fixing bath; and the other way is more simple and is conducted in one step employing a bleach-fixing bath containing both a bleaching agent and a fixing agent for the purpose of accelerating the processing and reducing the labor required.

Ferricyanide and ferric chloride, heretofore used as bleaching agents, are good bleaching agents because they have high oxidizing power. However, a bleaching solution or bleach-fixing solution containing ferricyanide as a bleaching agent releases poisonous cyanide by photolysis causing environmental pollution. Accordingly, waste processing solutions thereof must be rendered harmless from the viewpoint of environmental pollution. A bleaching solution containing ferric chloride as a bleaching agent is not desirable because materials of vessels in which the solution is filled up are liable to be corroded due to the extremely low pH and high oxidizing power of the solution. In addition, iron hydroxide is precipitated in an emulsion layer during a water washing step after a bleaching step using ferric chloride, thereby resulting in staining.

On the other hand, potassium dichromate, quinones, copper salts, etc., which have been used as bleaching agents have weak oxidizing power and are difficult to handle.

In recent years, bleach processing using a ferric ion complex salt (e.g., aminopolycarboxylic acid-ferric ion complex salt, particularly iron (III) ethylenediaminetetraacetate complex salt, etc.) as a major bleaching bath component has mainly been employed in processing color light-sensitive materials in view of the acceleration and simplification of the bleaching provided and the need to prevent environmental pollution.

However, ferric ion complex salts have a comparatively low oxidizing power, and therefore, often have insufficient bleaching power. A bleaching or bleach-fixing solution containing such a complex salt when bleaching or bleach-fixing a low speed color light-sensitive material containing, for example, a silver chlorobromide emulsion as a major component. However, insufficient desilveration occurs in such a solution due to insufficient bleaching power or requires a long time to bleach when processing a high speed, spectrally sensitized color light-sensitive material containing a silver chlorobromoiodide emulsion or a silver iodobromide emulsion as a major component, particularly color reversal light-sensitive materials for photographing or color negative light-sensitive materials for photographing comprising an emulsion containing a larger amount of silver.

Known bleaching agents other than ferric ion complex salts include persulfates. Persulfates are usually used in a bleaching solution together with a chloride. However, persulfate-containing bleaching solution has less bleaching ability than ferric ion complex salts, and thus, requires a substantially long period of time for bleaching.

In the color light-sensitive materials, sensitizing dyes are generally employed for the purpose of spectral sensitization. In particular, when a tabular grain silver halide emulsion containing a large amount of silver or having a high aspect ratio in order to achieve high sensitivity is employed, a problem occurs in that sensitizing dyes adsorbed on the surfaces of silver halide grains interfere with the bleaching of silver formed in the development of the silver halide.

Heretofore, various compounds have been proposed as means for enhancing the bleaching ability of color light-sensitive materials by incorporating such as a bleach accelerating agent therein.

Examples of such bleach accelerating agents include mercapto compounds as described in U.S. Pat. Nos. 3,893,858 and 4,508,816, Japanese Patent Application (OPI) Nos. 147529/78, 58532/77 (the term "OPI" as used herein refers to a "published unexamined Japanese patent application"), etc., or compounds having an

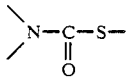

group as described in U.S. Pat. No. 4,481,290, etc. However, these compounds do not always show a satisfactory bleach accelerating effect. Moreover, many of them have a disadvantage in that they cause insufficient fixing. Further, diamino compounds as described in U.S. Pat. No. 4,552,834 often have a less bleach accelerating effect than desired effect, although usually being sufficient for practical purpose of fixing.

SUMMARY OF THE INVENTION

Therefore, one object of the present invention is to provide a method for processing a color light-sensitive material, which does not release extremely poisonous materials, which meets the requirement of preventing environmental pollution, which has excellent bleaching speed, and which does not cause insufficient fixing.

Another object of the present invention is to provide a method involving a bleaching or bleach-fixing step in which enhanced bleaching ability is attained without deteriorating other photographic properties using a bleaching agent having a weak bleaching ability, particularly a ferric ion complex salt or a persulfate.

A further object of the present invention is to provide a bleach accelerating agent which can increase bleaching speed when incorporated into a color light-sensitive material.

A still further object of the present invention is to provide a method which can rapidly bleach or bleach-fix a color light-sensitive material having photographic speed.

A still further object of the present invention is to provide a color light-sensitive material using a tabular grain silver halide emulsion containing a large amount of silver or having a high aspect ratio (diameter/thickness), which does not substantially cause incomplete bleaching due to adsorption of sensitizing dyes to silver.

Other objects of the present invention will become apparent from the following description and examples.

As a result of extensive investigations, it has been found that these objects of the present invention can be attained by employing a silver halide color photographic material comprising a support having thereon at least one photographic emulsion layer containing tabular silver halide grains having an average aspect ratio (diameter of grains/thickness of grains) of 5 or more and the silver halide color photographic material containing at least one compound represented by formula (I)

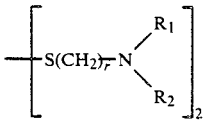

(I)

wherein $R_1$ and $R_2$ (which may be the same or different) each represents a hydrogen atom, an alkyl group or an acyl group, provided that $R_1$ and $R_2$ do not both represent hydrogen atoms at the same time, or $R_1$ and $R_2$ together form a ring; and r represents an integer of from 1 to 3, and by subjecting the silver halide color photographic material, after subjecting the exposed color photographic material to color development, to treatment with a bath having at least a bleaching ability.

DETAILED DESCRIPTION OF THE INVENTION

The compound represented by formula (I) is described in detail below.

In formula (I), $R_1$ and $R_2$, which may be the same or different, each represents a hydrogen atom, a substituted or unsubstituted alkyl group (preferably a lower alkyl group having from 1 to 5 carbon atoms, and particularly preferably a methyl group, an ethyl group or a propyl group), or a substituted or unsubstituted acyl group (preferably having from 2 to 4 carbon atoms, and particularly preferably an acetyl group, a propionyl group, etc.), provided that $R_1$ and $R_2$ are not both hydrogen atoms at the same time.

$R_1$ and $R_2$ may be bonded to each other to form a ring.

r represents an integer of from 1 to 3.

Examples of the substituents for the groups represented by $R_1$ and $R_2$ include a hydroxyl group, a carboxyl group, a sulfo group, an alkylsulfonyl group, an amino group, etc.

In $R_1$ or $R_2$, a substituted or unsubstituted lower alkyl group is particularly preferred.

Specific examples of the compounds represented by formula (I) are shown below, but the present invention should not be construed as being limited thereto.

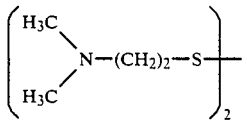

(1)

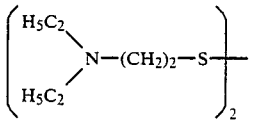

(2)

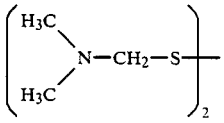

(3)

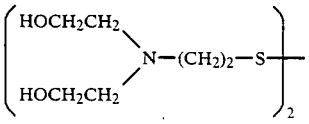

(4)

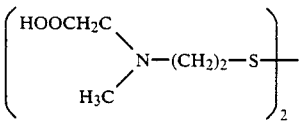

(5)

-continued (6)

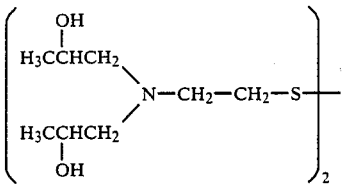

(7)

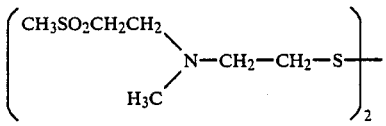

(8)

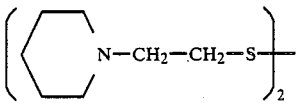

(9)

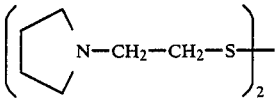

(10)

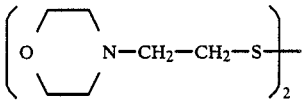

The compound represented by formula (I) used in the present invention can be easily synthesized by the method as described in Japanese Patent Application (OPI) No. 95630/78.

The compound represented by formula (I) according to the present invention can be added to any of the layers constituting the color light-sensitive material. Examples of such layers include an antihalation layer, an interlayer (which is provided between layers having different spectral sensitivities, between layers having the same spectral sensitivity, and between a light-sensitive layer, light-insensitive layer, etc.), a light-sensitive silver halide emulsion layer, a light-insensitive silver halide emulsion layer, a yellow filter layer, a protective layer, etc. Further, the compound may be added to two or more layers.

Two or more kinds of the compounds can be employed in the color light-sensitive material. The total amount of the compound to be added is generally in the range of from $1\times10^{-5}$ to $1\times10^{-2}$ mol/m$^2$, preferably from $2\times10^{-5}$ to $5\times10^{-3}$ mol/m$^2$, and more preferably from $5\times10^{-5}$ to $2\times10^{-3}$ mol/m$^2$.

In order to introduce the compound into the color light-sensitive material, it is added to a coating solution directly or after dissolving it in a solvent which does not adversely affect the color of the light-sensitive material, for example, water, an alcohol, etc., in an appropriate concentration. Further, the compound is dissolved in an organic solvent having a high boiling point and/or an organic solvent having a low boiling point, then the solution is dispersed in an aqueous solution and the resulting dispersion is added to a coating solution.

In the following, the tabular silver halide grains used in the present invention are illustrated.

The tabular silver halide grains (which are also sometimes referred to in the art as "plate-like" silver halide grains) which are used in the present invention are those having an average aspect ratio (diameter/thickness) of 5 or more (i.e., 5/1 or more), for example, those having the ratio of more than 8 and those having the ratio of from 5 to 8, etc. Particularly, those having the average aspect ratio of from 5 to 8 are preferred.

Herein, the term "diameter" as applied to the silver halide grain means the average diameter of a circle which has an area equal to the project area of the grain. In the present invention, the diameter of tabular silver halide grains is in a range of generally from 0.3 to 5.0 μm, and preferably from 0.5 to 3.0 μm.

Furthermore, the term "thickness" as applied to the silver halide grain means the average thickness of the grain. The thickness of tabular silver halide grains is generally 0.4 μm or less, preferably 0.3 μm or less, and more preferably 0.2 μm or less.

Generally, the tabular silver halide grain is a plate having two parallel faces. Accordingly, the term "thickness" as used in the present invention is represented by the distance between the two parallel faces composing the tabular silver halide grain.

It is possible to use tabular silver halide grains which are subjected to monodispersion in the emulsion based on the grain diameter and/or thickness of the silver halide grains according to a method as described in Japanese Patent Publication No. 11386/72, etc.

The term "monodispersion" of a tabular grain silver halide emulsion as used herein means a tabular grain silver halide emulsion in which at least 95% of the total silver halide grains have a size within the range of generally ±60%, preferably ±40%, and more preferably ±20%, of the number average grain size. The number average grain size means a number average diameter calculated from the diameter of the project area of the silver halide grains.

With respect to the proportion of tabular silver halide grains in the silver halide emulsion containing tabular silver halide grains used in the present invention, it is desired that tabular silver halide grains occupy 50% or more, more preferably 70% or more, and particularly preferably 90% or more, based on the total project area of silver halide grains contained in the emulsion.

The halogen composition of the tabular silver halide grains is preferably silver bromide, silver iodobromide, silver chlorobromide, silver chloroiodobromide, silver chloride or silver iodochloride. For use in a high speed color light-sensitive material, silver iodochloride is particularly preferred. The content of silver iodide in silver iodochloride is usually 40 mol % or less, preferably 20 mol % or less, and more preferably 15 mol % or less. On the other hand, silver chlorobromide or silver bromide is particularly preferred in the case of color light-sensitive materials for print.

The tabular silver halide grains may have uniform halogen composition or may be composed of two or more phases having different halogen compositions.

For example, in the case of silver iodobromide, tabular silver iodobromide grains having a stratiform structure composed of plural phases having an iodide content different from each other can be used.

Preferred examples of the halogen composition and halogen distribution in grains of the tabular silver halide grains are described in Japanese Patent Application (OPI) Nos. 113928/83 and 99433/84, etc. Generally speaking, it is desirable to select the optimum relationship of a relative content of iodide contained in each phase of tabular silver halide grains depending on a kind of development processing applied to the color light-sensitive material containing these tabular silver halide grains (for example, an amount of a silver halide solvent present in a developing solution, etc.).

The tabular silver halide grains may be junction type silver halide crystals in which crystals of an oxide such as lead oxide are connected with crystals of a silver halide such as silver chloride, or silver halide crystals upon epitaxial growth (for example, crystals prepared by epitaxial growth of silver chloride, silver iodobromide, silver iodide, etc., on silver bromide crystals, or crystals prepared by epitaxial growth of silver chloride, silver bromide, silver iodide, silver chloroiodobromide on hexagonal or octahedral silver iodide crystals), etc. Examples of these grains are described in U.S. Pat. Nos. 4,435,501 and 4,463,087, etc.

With respect to site of latent image formation, either grains in which latent images are formed mainly on the surface thereof or grains in which latent images are formed mainly in the interior thereof can be employed. This is appropriately selected depending on the use of the color light-sensitive material in which the tabular silver halide grains are employed, or the depth of latent images in the grains which can be developed with a developing solution used in processing of the color light-sensitive material.

Preferred methods for using the tabular silver halide grains are described in detail in *Research Disclosure,* RD No. 22534 (January, 1983) and ibid., RD No. 25330 (May, 1985). In these literature, for example, a method for using tabular grains based on the relation between the thickness of tabular grains and the optical property thereof is described.

Crystal structure of the silver halide grains may be uniform, may be composed of different halide compositions between the inner portion and the outer portion, or may have a layer structure. Examples of such emulsion grains are described in British Patent No. 1,027,146, U.S. Pat. Nos. 3,505,068 and 4,444,877, Japanese Patent Application (OPI) No. 143331/85, etc.

Further, silver halide emulsions in which silver halide grains having different compositions are connected upon epitaxial junctions or silver halide emulsions in which silver halide grains are connected with compounds other than silver halide such as silver thiocyanate, lead oxide, etc., may also be employed. Examples of these emulsion grains are described in U.S. Pat. Nos. 4,094,684, 4,142,900 and 4,459,353, British Patent No. 2,038,792, U.S. Pat. Nos. 4,349,622, 4,395,478, 4,433,501, 4,463,087, 3,656,962 and 3,852,067, Japanese Patent Application (OPI) No. 162540/84, etc.

Moreover, a mixture of grains having various crystal forms may be employed.

In order to accelerate ripening of silver halide grains, silver halide solvents are useful. For example, it is known that an excess amount of halogen ions is supplied to a reaction vessel for the purpose of facilitating the ripening. Therefore, it is apparent that the ripening can be facilitated only by introducing a solution of halide into the reaction vessel. Other ripening agents can also be employed. These ripening agents can wholly be provided to a dispersing medium in the reaction vessel before the addition of a silver salt and a halide or they may be introduced into the reaction vessel together with one or more of a silver salt, a halide and a deflocculating agent. In another embodiment, the ripening agent may be introduced independently at the stage of addition of a silver salt or a halide.

Examples of ripening agents to be used other than the halogen ions include ammonia, amine compounds, thiocyanates, for example, alkali metal thiocyanates, particularly sodium thiocyanate and potassium thiocyanate, and ammonium thiocyanate. The use of thiocyanate type ripening agents is described in U.S. Pat. Nos. 2,222,264, 2,448,543 and 3,320,069, etc. Further, conventional thioether type ripening agents as described in U.S. Pat. Nos. 3,271,157, 3,574,628 and 3,737,313, etc., can be employed. Moreover, thione compounds as described in Japanese Patent Application (OPI) Nos. 82408/78 and 144319/78 can be used.

Properties of silver halide grains can be controlled by means of the presence of various compounds at the stage of formation of silver halide grains. Such compounds can be provided initially in the reaction vessel. Further, they may be added to the reaction vessel together with one or more of salts. Characteristics of silver halide grains can be controlled by the presence of the compounds such as compounds of copper, iridium, lead, bismuth, cadmium, zinc, chalcogen (such as sulfur, selenium, tellurium, etc.), gold and noble metal of the group VIII in the Periodic Table as described in U.S. Pat. Nos. 2,448,060, 2,628,167, 3,737,313 and 3,772,031, *Research Disclosure,* Vol. 134, RD No. 13452 (June, 1975), etc. The silver halide emulsion can be subjected to reduction sensitization in the interior of grains at the stage of formation of grains as described, e.g., in Japanese Patent Publication No. 1410/83 and Moisar et al., *Journal of Photographic Science,* Vol. 25, pages 19 to 27 (1977).

The silver halide emulsion is usually chemically sensitized. The chemical sensitization can be carried out using active gelatin as described in T. H. James, *The Theory of the Photographic Process,* 4th Ed., pages 67 to 76 (The Macmillan Co., 1977). Further, the chemical sensitization can be conducted using a sensitizer such as sulfur, selenium, tellurium, gold, platinum, palladium, iridium or a combination of two or more thereof at pAg of 5 to 10, pH of 5 to 8 and temperature of 30° to 80° C. as described in *Research Disclosure,* Vol. 120, RD No. 12008 (April, 1974), ibid., Vol. 134, RD No. 13452

(June, 1975), U.S. Pat. Nos. 2,642,361, 3,297,446, 3,772,031, 3,857,711, 3,901,714, 4,266,018 and 3,904,415, British Patent No. 1,315,755, etc. Suitable chemical sensitization is conducted in the presence of a gold compound and a thiocyanate compound or in the presence of a sulfur containing compound as described in U.S. Pat. Nos. 3,857,711, 4,266,018 and 4,054,457 or a sulfur containing compound such as hypo, a thiourea type compound, a rhodanine type compound, etc.

The chemical sensitization may be carried out in the presence of a chemically sensitizing assistant. Examples of the chemically sensitizing assistants to be employed include compounds which are known as compounds for preventing fog during the chemical sensitization step and increasing sensitivity, such as azaindene, azapyridazine, azapyrimidine, etc. Examples of chemically sensitizing assistant modifiers are described in U.S. Pat. Nos. 2,131,038, 3,411,914 and 3,554,757, Japanese Patent Application (OPI) No. 126526/83, G. F. Duffin, *Photographic Emulsion Chemistry,* pages 138 to 143 (The Focal Press, 1966), etc.

In addition to or in place of the chemical sensitization, reduction sensitization using hydrogen as described in U.S. Pat. Nos. 3,891,446, 3,984,249, etc., reduction sensitization using a reducing agent such as stannous chloride, thiourea dioxide, a polyamine, etc., as described in U.S. Pat. Nos. 2,518,698, 2,743,182, 2,743,183, etc., or reduction sensitization using treatment at low pAg (for example, pAg of less than 5) and/or high pH (for example, pH of more than 8) can be conducted.

Moreover, spectral sensitivity can also be improved using the chemical sensitization as described in U.S. Pat. Nos. 3,917,485, 3,966,476, etc.

The tabular silver halide grains are preferably coated in an amount of from 0.5 to 6 g/m$^2$, and particularly preferably from 1 to 4 g/m$^2$ (per one side of a support).

Ordinary silver halide grains (fo example, spherical grains) may be incorporated into the emulsion layer of the color light-sensitive material of the present invention in addition to the tabular silver halide grains. Such grains can be prepared by the methods as described in P. Glafkides, *Chimie et Physique Photographique* (Paul Montel, 1967); G. F. Duffin, *Photographic Emulsion Chemistry* (The Focal Press, 1966); and V. L. Zelikman et al., *Making and Coating Photographic Emulsion* (The Focal Press, 1964), etc. Further, the emulsion layer may contain a monodispersed emulsion in addition to the tabular silver halide grains.

Representative monodispersed emulsions are those comprising silver halide grains having an average grain diameter of about 0.1 μm or more and at least about 95% by weight of the total silver halide grains having a diameter within the range of ±40% of the average grain diameter. In the present invention, monodispersed emulsions which can be used comprise silver halide grains having an average grain diameter of from about 0.25 μm to about 2 μm and at least 95% by weight or by number of particles of the total silver halide grains having a diameter within the range of ±20% of the average grain diameter. Methods for preparation of such monodispersed emulsions are described in U.S. Pat. Nos. 3,574,628 and 3,655,394, British Patent No. 1,413,748, etc. Further, monodispersed emulsions as described in Japanese Patent Application (OPI) Nos. 8600/73, 39027/76, 83097/76, 137133/78, 48521/79, 99419/79, 37635/83, 49938/83, etc., can be preferably employed in the present invention.

The tabular silver halide photographic emulsion used in the present invention can also be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful.

Any conventionally utilized nuclei for cyanine dyes are applicable to these dyes as basic heterocyclic nuclei. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by fusing alicyclic hydrocarbon rings with these nuclei and nuclei formed by fusing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei can also be substituted.

The merocyanine dyes and the complex merocyanine dyes that can be employed contain 5- or 6-membered heterocyclic nuclei such as a pyrazolin-5-one nucleus, a thiohydantoin nucleus, a 2-thioxazolidin-2,4-dione nucleus, a thiazolidone-2,4-dione nucleus, a rhodanine nucleus, a thiobarbituric acid nucleus, and the like.

These sensitizing dyes may be employed individually, and may also be employed in combination. A combination of sensitizing dyes if often used particularly for the purpose of supersensitization.

The sensitizing dyes may be present in the emulsion together with dyes which themselves do not have spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those as described in U.S. Pat. Nos. 2,933,390 and 3,635,721), aromatic organic acid-formaldehyde condensates (e.g., those as described in U.S. Pat. No. 3,743,510), cadmium salts, azaindene compounds, and the like, may be present. The combinations as described in U.S. Pat. Nos. 3,615,613, 3,615,641, 3,617,295, 3,635,721, etc., are particularly useful.

The spectral sensitization of the silver halide emulsion according to the present invention can be carried out at any stage of the preparation thereof.

In general, spectral sensitizing dyes are added to the chemically sensitized emulsion before coating of the emulsion. The method wherein spectrally sensitizing dyes are added to the emulsion before or during chemical sensitization as described in U.S. Pat. No. 4,425,426, etc., may be employed. Further, the method in which spectral sensitizing dyes are added to the emulsion before the completion of the formation of silver halide grains as described in U.S. Pat. Nos. 2,735,766, 3,628,960, 4,183,756, 4,225,666, etc., may be used. Particularly, according to the method in which spectrally sensitizing dyes are added to the emulsion after the formation of stable nuclei in the step of formation of silver halide grains as described in U.S. Pat. Nos. 4,183,756 and 4,225,666, the increase in photographic sensitivity and the intensified adsorption of spectrally sensitizing dyes on silver halide grains are advantageously obtained.

In addition, conventional photographic additives which can be used in the present invention are described in the below-mentioned *Research Disclosure* (RD Nos. 17643 and 18716), and the relevant portions thereof are also set forth in the following Table.

| No. | Kinds of Additives | RD No. 17643 | RD No. 18716 |
|---|---|---|---|
| 1 | Chemical sensitizer | Page 23 | Page 648, right column |
| 2 | Sensitivity accelerator | — | Page 648, right column |
| 3 | Spectral sensitizer, Supersensitizer | Pages 23 and 24 | Page 648, right column to page 649, right column |
| 4 | Brightening agent | Page 24 | — |
| 5 | Antifoggants, Stabilizer | Pages 24 and 25 | Page 649, right column |
| 6 | Light absorbent, Filter dye, UV absorbent | Pages 25 and 26 | Page 649, right column to page 650, left column |
| 7 | Stain inhibitor | Page 25, right column | Page 650, right to left column |
| 8 | Color image stabilizer | Page 25 | — |
| 9 | Hardener | Page 26 | Page 651, left column |
| 10 | Binder | Page 26 | Page 651, left column |
| 11 | Plasticizer, Lubricant | Page 27 | Page 650, right column |
| 12 | Coating aid, Surfactant | Pages 26 and 27 | Page 650, right column |
| 13 | Antistatic agent | Page 27 | Page 650, right column |

The photographic emulsion layer of the color light-sensitive material of the present invention may contain compounds such as polaylkylene oxide or its ether, ester, amine or derivatives thereof, thioether compounds, thiomorpholines, quaternary ammonium salt compounds, urethane derivatives, urea derivatives, imidazole derivatives, and 3-pyrazolidones for the purpose of increasing sensitivity or contrast, or of accelerating development. For example, those as described in U.S. Pat. Nos. 2,400,532, 2,423,549, 2,716,062, 3,617,280, 3,772,021 and 3,808,003, British Patent No. 1,488,991, etc., may be employed.

The photographic silver halide emulsion used in the present invention may include various compounds for the purpose of preventing fog formation or of stabilizing photographic performance in the photographic light-sensitive material during the production, storage or photographic processing thereof. For example, those compounds known as antifoggants or stabilizers can be incorporated, including azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole), etc.; mercaptopyrimidines; mercaptotriazines; thioketo compounds such as oxazolinethione, etc.; azaindenes such as triazaindenes, tetraazaindenes (particularly 4-hydroxy-substituted (1,3,3a,7)tetraazaindenes), pentaazaindenes, etc.; benzenethiosulfonic acids; benzenesulfinic acids; benzenesulfonic amides; etc.

Various dye forming couplers can be employed in the present invention. The terminology "dye forming coupler" as used herein refers to compounds capable of forming dyes upon coupling reaction with the oxidation products of aromatic primary amine developing agents. Typical examples of useful color couplers include naphthol or phenol type compounds, pyrazolone or pyrazoloazole type compounds and open chain or heterocyclic ketomethylene compounds. Specific examples of utilizable cyan, magenta and yellow couplers are described in the patents cited in *Research Disclosure,* RD No. 17643, VII-D (December, 1978) and ibid., RD No. 18717 (November, 1979).

It is preferable that these couplers which are incorporated into photographic light-sensitive materials are rendered diffusion resistant by means of containing a ballast group or being polymerized. It is also preferred that the coupling active position of these couplers is substituted with a group capable of being released (2-equivalent couplers) than with a hydrogen atom (4-equivalent couplers) form the standpoint that the coating amount of silver is reduced. Further, couplers which form dyes having an appropriate diffusibility, non-color-forming couplers, or couplers capable of releasing development inhibitors (DIR couplers) or development accelerators accompanying with the coupling reaction can also be employed.

Typical yellow couplers used in the present invention include oil protected acylacetamide type couplers. Specific examples thereof are described in U.S. Pat. Nos. 2,407,210, 2,875,057, 3,265,506, etc. In the present invention, 2-equivalent yellow couplers are preferably employed and typical examples thereof include yellow couplers of oxygen atom releasing type as described in U.S. Pat. Nos. 3,408,194, 3,447,928, 3,933,501, 4,022,620, etc., and yellow couplers of nitrogen atom releasing type as described in Japanese Patent Publication No. 10739/83, U.S. Pat. Nos. 4,401,752 and 4,326,024, *Research Disclosure,* RD No. 18053 (April, 1979), British Patent No. 1,425,020, West German Patent Application (OLS) Nos. 2,219,917, 2,261,361, 2,329,587, 2,433,812, etc. α-Pivaloylacetanilide type couplers are characterized by fastness, particularly light fastness, of the dyes formed, and α-benzoylacetanilide type couplers are characterized by providing a high color density.

Magenta couplers used in the present invention include oil protected indazolone type couplers, cyanoacetyl type couplers, and preferably 5-pyrazolone type couplers and pyrazoloazole type couplers such as pyrazolotriazoles. Of 5-pyrazoloe type couplers, those substituted with an arylamine group or an acylamino group at the 3-position thereof are preferred in view of hue and a color density of dyes formed. Typical examples thereof are described in U.S. Pat. Nos. 2,311,082, 2,343,703, 2,600,788, 2,908,573, 3,062,653, 3,152,896, 3,936,015, etc. 2-Equivalent 5-pyrazolone type couplers are preferably used. Particularly, nitrogen atom releasing groups as described in U.S. Pat. No. 4,310,619 and arylthio groups as described in U.S. Pat. No. 4,351,897 are preferred as releasing groups. Further, 5-pyrazolone type couplers having a ballast group as described in European Patent No. 73,636 are advantageous because they provide a high color density.

Examples of pyrazoloazole type couplers include pyrazolobenzimidazoles as described in U.S. Pat. No. 3,061,432, and preferably pyrazolo[5,1-c][1,2,4]triazoles as described in U.S. Pat. No. 3,725,067, pyrazolotetrazoles as described in *Research Disclosure,* RD No. 24220 (June, 1984) and Japanese Patent Application (OPI) No. 33552/85 and pyrazolopyrazoles as described in *Research Disclosure,* RD No. 24230 (June, 1984) and Japanese Patent Application (OPI) No. 43659/85. Imidazo[1,2-b]pyrazoles as described in U.S. Pat. No. 4,500,630 are preferred and pyrazolo[1,5-b][1,2,4]triazoles as described in U.S. Pat. No. 4,540,654 are particularly preferred in view of less yellow subsidiary absorption and light fastness of dyes formed.

As cyan couplers used in the present invention, oil protected naphthol type and phenol type couplers are exemplified. Typical examples thereof include naphthol type couplers as described in U.S. Pat. No. 2,474,293 and preferably oxygen atom releasing type 2-equivalent naphthol type couplers as described in U.S. Pat. Nos. 4,052,212, 4,146,396, 4,228,233, 4,296,200, etc. Specific examples of phenol type couplers are described in U.S. Pat. Nos. 2,369,929, 2,801,171, 2,772,162, 2,895,826, etc.

Cyan couplers fast to humidity and temperature are preferably used in the present invention. Typical examples thereof include phenol type cyan couplers having an alkyl group having more carbon atoms than a methyl group at the meta-position of the phenol nucleus as described in U.S. Pat. No. 3,772,002, 2,5-diacylamino-substituted phenol type couplers as described in U.S. Pat. Nos. 2,772,162, 3,758,308, 4,126,396, 4,334,011 and 4,327,173, West German Patent Application (OLS) No. 3,329,729, European Patent No. 121,365, etc., and phenol type couplers having a phenylureido group at the 2-position thereof and an acylamino group at the 5-position thereof as described in U.S. Pat. Nos. 3,446,622, 4,333,999, 4,451,559, 4,427,767, etc. Further, naphthol type cyan couplers having a sulfonamido group, or an amido group, etc., at the 5-position thereof as described in Japanese Patent Application (OPI) No. 237448/85, Japanese Patent Application Nos. 264277/84, 268135/84, etc., are excellent in fastness of color image formed therefrom and preferably used in the present invention.

It is preferred to use colored couplers together in color negative photographic light-sensitive materials for photography in order to correct undesirable absorptions in shorter wavelength regions which dyes formed from magenta couplers and cyan couplers used have. Typical examples include yellow-colored magenta couplers as described in U.S. Pat. No. 4,163,670, Japanese Patent Publication No. 39413/82, etc., and magenta-colored cyan couplers as described in U.S. Pat. Nos. 4,004,929 and 4,138,258, British Patent No. 1,146,368, etc.

Furthermore, couplers capable of forming appropriately diffusible dyes can be used in combination in order to improve graininess properties. Specific examples of such blur couplers are described in U.S. Pat. No. 4,366,237, British Patent No. 2,125,570, etc., and those of yellow, magenta and cyan couplers are described in European Patent No. 96,570, West German Patent Application (OLS) No. 3,234,533, etc.

These dye forming couplers and special couplers described above may be used in the form of polymers including dimers or more. Typical examples of dye-forming polymer couplers are described in U.S. Pat. Nos. 3,451,820, 4,080,211, etc. Specific examples of magenta polymer couplers are described in British Patent No. 2,102,173, U.S. Pat. No. 4,367,282, Japanese Patent Application Nos. 75041/85, 113596/85, etc.

Two or more kinds of various couplers which can be used in the present invention can be incorporated together into the same layer for the purpose of satisfying the properties required to the color light-sensitive material, or the same compound can also be incorporated into different two or more layers.

The dye forming couplers are generally employed in an mmount of from 0.001 mol to 1 mol per mol of light-sensitive silver halide contained in a layer to be added. It is preferred that amounts of yellow couplers, magenta couplers and cyan couplers used are in ranges of from 0.01 mol to 0.5 mol, from 0.003 mol to 0.3 mol, and from 0.002 mol to 0.3 mol, per mol of light-sensitive silver halide, respectively.

The color light-sensitive material of the present invention may contain couplers capable of releasing a development inhibitor as proceeding of development, i.e., so-called DIR couplers.

DIR couplers that can be used in the present invention include those which release a heterocyclic mercapto type development inhibitor as described in U.S. Pat. No. 3,227,554, etc., those which release a benzotriazole derivative as a development inhibitor as described in Japanese Patent Publication No. 9942/83, etc., so-called non-color-forming DIR couplers as described in Japanese Patent Publication No. 16141/76, etc., those which release a nitrogen-containing heterocyclic development inhibitor upon decomposition of methylol after cleavage as described in Japanese Patent Application (OPI) No. 90932/77; those which release a development inhibitor upon intramolecular nucleophilic reaction after cleavage as described in U.S. Pat. No. 4,248,962, and Japanese Patent Application (OPI) No. 56837/82, those which release a development inhibitor upon electron transfer via a conjugated system after cleavage as described in Japanese Patent Application (OPI) Nos. 114946/81, 154234/82, 188035/82, 98728/83, 209736/83, 209737/83, 209738/83, 209739/83, 209740/83, etc., those which release a diffusible development inhibitor which deactivate its development-inhibiting function in a developing agent as described in Japanese Patent Application (OPI) Nos. 151944/82, 217932/83, etc., and those which release a reactive compound which reacts in a layer during development to form a development inhibitor or to deactivate a development inhibitor as described in Japanese Patent Application (OPI) Nos. 182438/85, 184248/85, etc. Of these DIR couplers described above, those of deactivation type in a developing solution as represented by Japanese Patent Application (OPI) No. 151944/82, those of timing type as represented by U.S. Pat. No. 4,248,962 and Japanese Patent Application (OPI) No. 154234/82 and those of reactive type as represented by Japanese Patent Application (OPI) No. 184248/85 are preferably used in the case of the present invention. Further, DIR couplers of deactivation type in a developing solution as described in Japanese Patent Application (OPI) Nos. 151944/82, 217932/83, 218644/85, 225156/85, 233650/85, etc., and DIR couplers of reactive type as described in Japanese Patent Application (OPI) No. 184248/85, etc., are particularly preferred.

In the color light-sensitive material of the present invention, compounds which imagewise release a nucleating agent, a development accelerator, or a precursor thereof (hereinafter referred to collectively as a "development accelerator, etc.") during proceeding of development can be employed. Typical examples of these compounds are couplers which release a development accelerator, etc., upon the coupling reaction with the oxidation products of aromatic primary amine developing agents, that is, DAR couplers as described in British Patent Nos. 2,097,140, 2,131,188, etc.

DAR couplers capable of releasing a development accelerator, etc., having an adsorbing group to silver halide are preferred. Specific examples of such DAR couplers are described in Japanese Patent Application (OPI) Nos. 157638/84, 170840/84, etc. DAR couplers capable of releasing N-acyl-substituted hydrazine which is released from the coupling active position of a photographic coupler at its sulfur atom or the nitrogen atom and which has a monocyclic or condensed heterocyclic ring as an adsorbing group are particularly preferred. Specific examples of these DAR couplers are described in Japanese Patent Application (OPI) No. 128446/85, etc.

Compounds having a development accelerator portion in coupler residue thereof as described in Japanese Patent Application (OPI) No. 37556/85 or compounds capable of releasing a development accelerator upon the oxidation reduction reaction with developing agents as described in Japanese Patent Application (OPI) No. 107029/85 may also be employed in the color light-sensitive material of the present invention.

DAR couplers are preferably incorporated into a light-sensitive silver halide emulsion of the color light-sensitive material of the present invention. Further, it is preferred to incorporate substantially light-insensitive silver halide grains into at least one photographic constituting layer as described in Japanese Patent Application (OPI) Nos.172640/84, 128409/85, etc.

The color light-sensitive material used in the present invention may contain hydroquinone derivatives, aminophenol derivatives, amines, gallic acid derivatives, catechol derivatives, ascorbic acid derivatives, non-color-forming couplers, sulfonamidophenol derivatives, etc., as color antifoggants or anti-fading agents.

In the color light-sensitive material used in the present invention, various known color anti-fading agents can be employed. Typical examples of known color anti-fading agents include hindered phenols, for example, hydroqunones, 6-hydroxychromans, 5-hydroxycoumarans, spirochromans, p-alkoxyphenols, bisphenols, etc., gallic acid derivatives, methylenedioxybenzenes, aminophenols, hindered amines, or ether or ester derivatives thereof derived from each of these compounds by sililation or alkylation of the phenolic hydroxy group thereof. Further, metal complexes represented by (bissalicylaldoxymate) nickel complexes and (bis-N,N-dialkyldithiocarbamate) nickel complexes may also be employed.

The color light-sensitive material of the present invention may contain an ultraviolet ray absorbing agent in a hydrophilic colloid layer thereof. Examples of the ultraviolet ray absorbing agents that can be used include benzotriazole compounds substituted with an aryl group as described in U.S. Pat. Nos. 3,533,794 and 4,236,013, Japanese Patent Publication No. 6540/76, European Patent No. 57,160, etc., butadiene compounds as described in U.S. Pat. Nos. 4,450,229, 4,195,999, etc., cinnamic acid ester compounds as described in U.S. Pat. Nos. 3,705,805, 3,707,375, etc., benzophenone compounds as described in U.S. Pat. No. 3,215,530, British Patent No. 1,321,355, etc., and polymeric compounds having ultraviolet ray-absorbing group as described in U.S. Pat. Nos. 3,761,272, 4,431,726, etc.

Further, brightening agents having ultraviolet ray absorbing function as described in U.S. Pat. Nos. 3,499,762, 3,700,455, etc., may be used. Typical examples of useful ultraviolet ray absorbing agents are also described in *Research Disclosure,* RD No. 24239 (June, 1984), etc.

The color light-sensitive material according to the present invention may contain one or more kinds of surface active agents for various purposes such as improvement of coating properties, antistatic properties, sliding properties, emulsion dispersibility, anti-adhesion properties, and photographic properties (for example, development acceleration, increasing contrast, sensitization, etc.).

The color light-sensitive material of the present invention may contain water-soluble dyes as filter dyes or for irradiation or halation prevention or other various purposes in a hydrophilic colloid layer thereof. Those dyes preferably used include oxonol dyes, hemioxonol dyes, styryl dyes, merocyanine dyes, anthraquinone dyes, and azo dyes. In addition, cyanine dyes, azomethine dyes, triarylmethane dyes, and phthalocyanine dyes are also useful. It is also possible to emulsify oil-soluble dyes by an oil droplet in water type dispersing method and then added to a hydrophilic colloid layer.

In order to incorporate oleophilic compounds such as photographic couplers into a hydrophilic colloid layer of the color light-sensitive material according to the present invention, various methods, for example, an oil droplet-in-water type dispersing method, a latex dispersing method, a solid dispersing method, an alkali dispersing method, etc., can be employed. A preferred method can be suitably selected depending on the chemical structure and the physical and chemical properties of the compound to be introduced.

The photographic couplers used in the present invention can be added to one or more silver halide emulsion layers, etc., preferably by means of a latex dispersing method, and more preferably an oil droplet-in-water type dispersing method. By means of the oil droplet-in-water type dispersing method, couplers are dissolved in an organic solvent having a high boiling point of 175° C. or more at a normal pressure (hereinafter referred to as an "oil") or a mixture thereof with an auxiliary solvent having a low boiling point, if desired, and then the solution is finely dispersed in water or an aqueous solution of a binder such as gelatin, etc., in the presence of a surface active agent.

Typical examples of the organic solvents having a high boiling point include phthalates as described in U.S. Pat. Nos. 2,272,191 and 2,322,027, Japanese Patent Application (OPI) Nos. 31728/79, 118246/79, etc., phosphates or phosphonates as described in Japanese Patent Application (OPI) Nos. 1520/78 and 36869/80, U.S. Pat. Nos. 3,676,137, 4,217,410, 4,278,757, 4,326,022, 4,353,979, etc., benzoates as described in U.S. Pat. No. 4,080,209, etc., amides as described in U.S. Pat. Nos. 2,533,514, 4,106,940, 4,127,413, etc., alcohols or phenols as described in Japanese Patent Application (OPI) Nos. 27922/76, 13414/78, 130028/78, U.S. Pat. No. 2,835,579, etc., aliphatic carboxylic acid esters as described in Japanese Patent Application (OPI) Nos. 26037/76, 27921/76, 149028/76, 34715/77, 1521/78, 15127/78, 58027/79, 64333/81, 114940/81, U.S. Pat. Nos. 3,748,141, 3,779,765, 4,004,928, 4,430,421, 4,430,422, etc., anilines as described in Japanese Patent Application (OPI) No. 105147/83, etc., hydrocarbons as described in Japanese Patent Application (OPI) Nos. 62632/75 and 99432/79, U.S. Pat. No. 3,912,515, etc., and in addition as described in Japanese Patent Application (OPI) No. 146622/78, U.S. Pat. Nos. 3,689,271, 3,700,454, 3,764,336, 3,765,897, 4,075,022 and 4,239,851, West German Patent Application (OLS) No. 2,410,914, etc. Two or more kinds of organic solvents having a high boiling point may be employed together and examples of using phthalates together with phosphates are described in U.S. Pat. No. 4,327,175.

It is also possible to utilize the dispersing method using polymers, as described in Japanese Patent Application (OPI) No. 59943/76, Japanese Patent Publication Nos. 39853/76 and 126830/81, U.S. Pat. Nos. 2,772,163, 4,201,589, etc.

As the binder or the protective colloid for the photographic emulsion layers or interlayers of the color light-sensitive material according to the present invention, gelatin is advantageously used, but other hydrophilic colloids can also be used.

For example, it is possible to use proteins such as gelatin derivatives, graft polymers of gelatin and other polymers, albumin, casein, etc., saccharides such as cellulose derivatives such as hydroxyethyl cellulose, carboxymethyl cellulose, cellulose sulfate, etc., sodium alginate, starch derivatives, etc., and various synthetic hydrophilic polymeric substances such as homopolymers or copolymers, for example, polyvinyl alcohol, polyvinyl alcohol semiacetal, poly-N-vinylpyrrolidone, polyacrylic acid, polymethacrylic acid, polyacrylamide, polyvinylimidazole, polyvinylpyrazole, etc.

As gelatin not only lime-processed gelatin conventionally used, but also acid-processed gelatin and enzyme-processed gelatin as described in *Bull. Soc. Sci. Phot. Japan,* No. 16, page 30 (1966) may be used. Further, hydrolyzates of gelatin can also be used.

The color light-sensitive material of the present invention may contain inorganic or organic hardeners in the photographic light-sensitive layer and other hydrophilic colloid layers thereof including a backing layer. For example, chromium salts, aldehydes (e.g., formaldehyde, glyoxal, glutaraldehyde, etc.), N-methylol compounds (e.g., dimethylolurea, etc.) are illustrated. Active halogen compounds (e.g., 2,4-dichloro-6-hydroxy-1,3,5-triazine, etc.) and active vinyl compounds (e.g., 1,3-bisvinylsulfonyl-2-propanol, 1,2-bisvinylsulfonylacetamidoethane, a vinyl type polymer having vinylsulfonyl groups in its side chain, etc.) are preferred since they rapidly harden hydrophilic colloids such as gelatin and provide stable photographic characteristics. Also, N-carbamoylpyridinium salts or haloamidinium salts are preferred because of their high hardening speed.

The present invention can be applied to a multilayer multicolor photographic material having at least two differently spectrally sensitized photographic emulsion layers on a support. The multilayer natural color photographic material usually has at least one red-sensitive emulsion layer, at least one green-sensitive emulsion layer, and at least one blue-sensitive emulsion layer on a support. The order of the disposition of these emulsion layers can be suitably selected depending on the intended use. A preferred disposition is that a red-sensitive layer, a green-sensitive layer, and a blue-sensitive layer are arranged in this order from the support side. Further, each of the above-described emulsion layers may be composed of two or more emulsion layers having different sensitivities in order to increase sensitivity achieved, or may be composed of three layers in order to further improve graininess. Moreover, between two emulsion layers sensitive to the same spectral wavelength range, a light-insensitive layer may be present. Furthermore, between emulsion layers sensitive to the same spectral wavelength range, an emulsion layer sensitive to different spectral wavelength range therefrom may intervene.

In a multilayer multicolor photographic material, a filter layer which absorbs light having a specified wavelength range or a layer for the purpose of antihalation may be provided. In these light absorbing layers, not only the above-described organic dyes but also colloidal silver particles can be used.

For the purpose of increasing sensitivity based on light reflection or trapping of development inhibiting substances, a multilayer multicolor photographic light-sensitive material may have one or more light-insensitive layers containing a light-insensitive fine grain silver halide emulsion.

Typically, the red-sensitive emulsion layer contains a cyan coupler (i.e., a cyan color forming coupler), the green-sensitive emulsion layer contains a magenta coupler, and the blue-sensitive emulsion layer contains a yellow forming coupler, but different combinations may be employed, if desired. For example, in the case of false color photography or for semiconductor laser exposure, an infrared sensitive layer is combined. Further, a coupler which forms color other than color that is in the complementary color relation with light to which an emulsion layer is sensitive may be mixed in the emulsion layer in order to reduce unnatural color as described in Japanese Patent Publication No. 3481/58.

In the color light-sensitive material of the present invention, photographic emulsion layers and other layers are coated on a flexible support such as a plastic film, paper, cloth, etc., or a rigid support such as glass, ceramic, metal, etc., conventionally used for photographic light-sensitive materials. Examples of useful flexible support which can be used include films composed of semisynthetic or synthetic polymers such as cellulose nitrate, cellulose acetate, cellulose acetate butyrate, polystyrene, polyvinyl chloride, polyethylene terephthalate, polycarbonate, etc.; and paper coated or laminated with a baryta layer or an $\alpha$-olefin polymer (e.g., polyethylene, polypropylene, an ethylene-butene copolymer, etc.).

Supports may be colored with dyes or pigments. Further, they may be rendered black for the purpose of shielding light. The surfaces of these supports are, in general, subjected to a subbing treatment to increase adhesiveness to photographic emulsion layers. Before or after being subjected to the subbing treatment, the surfaces of the support may be subjected to a glow discharge treatment, a corona discharge treatment, an ultraviolet irradiation treatment, a flame treatment, etc.

In the present invention, photographic emulsion layers and other hydrophilic colloid layers can be coated on a support or other layers using various conventional coating methods. Examples of such coating methods include a dip coating method, a roller coating method, a curtain coating method, an extrusion coating method, etc. By the coating methods as described in U.S. Pat. Nos. 2,681,294, 2,761,791, 3,526,528, 3,508,947, etc., multilayers are coated at the same time, if desired.

Various means of exposure can be employed in the color light-sensitive material of the present invention. Any appropriate light sources emitting radiation corresponding to a light-sensitive wavelength range of the color light-sensitive material can be used as illuminating light sources or recording light sources. For example, natural light (sunlight), an incandescent lamp, a halogen lamp, a mercury lamp, a fluorescent lamp, and a flash light source such as an electronic flash (strobo) or a metal combustion flash bulb, etc., are generally employed. A gas, dye solution or semiconductor laser, a light-emitting diode, and a plasma light source, each of which emits light in a wavelength range from ultraviolet region to infrared region can also be employed as a recording light source. Further, a fluorescent surface emitted from a fluorescent body excited with electron beam, etc. (CRT, etc.), a microshutter alley utilizing a liquid crystal (LCD) or lead titanium zirconate doped with lanthanium (PLZT), etc., or an exposure means composed of a combination of line-state or face-state light sources may be used. Spectral distribution for exposure can be controlled by means of a color filter, if desired.

A color developing solution which can be used in development processing of the color light-sensitive material according to the present invention is an alkaline aqueous solution containing preferably an aromatic primary amine type developing agent as a main component. As the color developing agent, while an aminophenol type compound is useful, a p-phenylenediamine type compound is preferably employed. Typical examples of the p-phenylenediamine type compounds include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, or sulfate, chloride, phosphate, p-toluenesulfonate, tetraphenylborate or p-(tert-octyl)benzenesulfonate thereof, etc. These diamines are preferably employed in the form of salts since the salts are generally more stable than their free state.

The aminophenol type derivatives include, for example, o-aminophenol, p-aminophenol, 4-amino-2-methylphenol, 2-amino-3-methylphenol, 2-oxy-3-amino-1,4-dimethylbenzene, etc.

In addition, the compounds as described in L. F. A. Mason, *Photographic Processing Chemistry,* The Focal Press, pages 226 to 229 (1966), U.S. Pat. Nos. 2,193,015 and 2,592,364, Japanese Patent Application (OPI) No. 64933/73, etc., may be used.

Two or more kinds of color developing agents may be employed in a combination thereof, if desired.

The color-developing solution can further contain pH buffering agents, such as carbonates, borates or phosphates of alkali metals, etc.; development inhibitors or antifoggants such as bromides, iodides, benzimidazoles, benzothiazoles or mercapto compounds, etc.; preservatives such as hydroxylamine, triethanolamine, the compounds as described in West German Patent Application (OLS) No. 2,622,950, sulfites, bisulfites, etc.; organic solvents such as diethylene glycol, etc.; development accelerators such as benzyl alcohol, polyethylene glycol, quaternary ammonium salts, amines, thiocyanates, 3,6-dithiaoctane-1,8-diol, etc.; dye forming couplers; competing couplers; nucleating agents such as sodium borohydride, etc.; auxiliary developing agents such as 1-phenyl-3-pyrazolidone, etc.; viscosity imparting agents; and chelating agents including aminopolycarboxylic acids represented by ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid, the compounds as described in Japanese Patent Application (OPI) No. 195845/83, etc., aminophosphonic acids such as 1-hydroxyethylidene-1,1'-diphosphonic acid, the organic phosphonic acid as described in *Research Disclosure,* RD No. 18170 (May, 1979), aminotris(methylenephosphonic acid), ethylenediamine-N,N,N',N'-tetramethylenephosphonic acid, etc., phosphonocarboxylic acids as described in Japanese Patent Application (OPI) Nos. 102726/77, 42730/78, 121127/79, 4024/80, 4025/80, 126241/80, 65955/80 and 65956/80, *Research Disclosure,* RD No. 18170 (May, 1979), etc.

The color developing agent can be used in an amount of generally from about 0.1 g to about 30 g, and preferably from about 1 g to about 15 g, per liter of the color developing solution. A pH of the color developing solution used is usually 7 or more and preferably in a range of from about 9 to about 13. Further, an amount of replenishment for the color developing solution can be reduced using a replenisher in which concentrations of halogenides, color developing agents, etc., are controlled.

In the case of development processing for reversal color light-sensitive materials, color development is usually conducted after black-and-white development. In a black-and-white developing solution, known black-and-white developing agents, for example, dihydroxybenzenes such as hydroquinone, hydroquinone monosulfonate, etc., 3-pyrazolidones such as 1-phenyl-3-pyrazolidone, etc., or aminophenols such as N-methyl-p-aminophenol, etc., may be employed, alone or in combination.

In the present invention, the terminology "bath having a bleaching ability" means a bath capable of contributing to the bleaching of developed silver by incorporating a bleaching component therein. Therefore, the bath also includes a bath having a bleach-fixing ability in addition to a conventional bleaching bath.

The processing bath having a bleaching ability may be composed of two or more baths. In such a case, the solution of the last bath may be introduced into the prebath, etc., using a cascade process or conversely a solution of a prebath may be introduced into an after-bath using a cascade process. Further, a water washing step (including a water washing bath using a small amount of washing water) may be provided between the processing baths having a bleaching ability.

Examples of bleaching agents which can be employed in the processing bath having a bleaching ability include compounds of a multivalent metal such as iron (III), cobalt (III), chromium (VI), copper (II), etc. (for example, ferricyanides, etc.); peracids; quinones; nitroso compounds; dichromates; organic complex salts of iron (III) or cobalt (III) (for example, complex salts of aminopolycarboxylic acids, such as ethylenediaminetetraacetic acid, diethylenetriaminepentaacetic acid, etc., aminopolyphosphonic acids, phosphonocarboxylic acids or organic phosphonic acids, etc., or complex salts of organic acids, such as citric acid, tartaric acid, malic acid, etc.); persulfates; hydrogen peroxide; permanganates; etc. Of these compounds, organic complex salts of iron (III) and persulfates are preferred in view of rapid processing and less environmental pollution.

Specific examples of useful aminopolycarboxylic acids, aminopolyphosphonic acids or salts thereof suitable for forming organic complex salts of iron (III) are shown below.

Ethylenediaminetetraacetic acid
Diethylenetriaminepentaacetic acid
Ethylenediamine-N-(β-oxyethyl)-N,N,N'-triacetic acid
1,2-Diaminopropanetetraacetic acid
Triethylenetetraminehexaacetic acid
Propylenediaminetetraacetic acid
Nitrilotriacetic acid
Nitrilotripropionic acid
Cyclohexanediaminetetraacetic acid
1,3-Diamino-2-propanoltetraacetic acid
Methyliminodiacetic acid
Iminodiacetic acid
Hydroxyliminodiacetic acid
Dihydroxyethylglycine
Ethyl ether diaminetetraacetic acid
Glycol ether diaminetetraacetic acid
Ethylenediaminetetrapropionic acid
Ethylenediaminedipropionic acid
Phenylenediaminetetraacetic acid
2-Phosphonobutane-1,2,4-triacetic acid
1,3-Diaminopropanol-N,N,N',N'-tetramethylenephosphonic acid
Ethylenediamine-N,N,N',N'-tetramethylenephosphonic acid
1,3-Propylenediamine-N,N,N',N'-tetramethylenephosphonic acid
1-Hydroxyethylidene-1,1'-diphosphonic ccid Of these compounds, iron (III) complex salt of ethylenediaminetetraacetic acid, diethylenetriaminepentaacetic acid, cyclohexanediaminetetraacetic acid, 1,2-diaminopropanetetraacetic acid or methyliminodiacetic acid are preferred because of their high bleaching power.

The iron (III) complex salts may be used in the form of a complex salt per se, or may be formed in situ in solution by using an iron (III) salt (e.g., ferric sulfate, ferric chloride, ferric nitrate, ferric ammonium sulfate or ferric phosphate, etc.) and a chelating agent (e.g., an aminopolycarboxylic acid, aminopolyphosphonic acid or phosphonocarboxylic acid, etc.). When they are used in the form of a complex salt, they may be used alone or in combination with two or more. On the other hand, when a complex is formed in situ in solution by using a ferric salt and a chelating agent, one, two or more ferric salts may be used. Further, one, two or more chelating agents may also be used. In every case, a chelating agent may be used in an excess amount of being necessary for forming a ferric ion complex salt.

A bleaching solution or a bleach-fixing solution containing the above-described ferric ion complex may further contain metal ions or complexes of metals other than iron such as calcium, magnesium, aluminum, nickel, bismuth, zinc, tungsten, cobalt, copper, etc., or hydrogen peroxide.

Suitable examples of persulfates which can be employed in the bleach processing or bleach-fixing processing according to the present invention include alkali metal persulfates, such as potassium persulfate, sodium persulfate, etc., and ammonium persulfate, etc.

The processing bath having a bleaching ability according to the present invention can include halogenating agents such as bromides (e.g., potassium bromide, sodium bromide, ammonium bromide, etc.), chlorides (e.g., potassium chloride, sodium chloride, ammonium chloride, etc.), or iodides (e.g., ammonium iodide, etc.). Further, one or more kinds of inorganic acids, organic acids, alkali metal salts thereof or ammonium salts thereof which have a pH buffering ability (e.g., boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc.), corrosion inhibitors (e.g., ammonium nitrate, guanidine, etc.), or the like may be added.

The amount of bleaching agent is generally from 0.1 to 2 mols per liter of the bleaching solution, and the pH of the bleaching solution is preferably from 0.5 to 8.0, when a ferric ion complex salt is used, and particularly from 4.0 to 7.0, when a ferric ion complex salt of an aminopolycarboxylic acid, aminopolyphosphonic acid, phosphonocarboxylic acid or organic phosphonic acid is used. In the case of using a persulfate, the amount of a persulfate is preferably from 0.1 to 2 mols per liter of the bleaching solution, and the pH of the bleaching solution is preferably from 1 to 5.

As fixing agents which can be employed in the fixing solution or bleach-fixing solution, known fixing agents, that is, water-soluble silver halide solvents such as thiosulfate (e.g., sodium thiosulfate, ammonium thiosulfate, etc.); thiocyanates (e.g., sodium thiocyanate, ammonium thiocyanate, etc.); thioether compounds (e.g., ethylenebisthioglycolic acid, 3,6-dithia-1,8-octanediol, etc.); and thioureas may be used alone or in combination with two or more. In addition, a special bleach-fixing solution comprising a combination of fixing agent and a large amount of a halide compound such as potassium iodide as described in Japanese Patent Application (OPI) No. 155354/80 can be used as well.

In the fixing bath or bleach-fixing bath, it is preferable that the amount of fixing agent is from 0.2 to 4 mols per liter of the fixing solution or bleach-fixing solution. In the bleach-fixing composition, it is desirable that the ferric ion complex salt is present in an amount of from 0.1 to 2 mols and the amount of fixing agent is from 0.2 to 4 mols, per liter of the bleach-fixing solution. Further, the pH of the fixing solution or bleach-fixing solution is preferably from 4.0 to 9.0, particularly preferably from 5.0 to 8.0.

A fixing solution or bleach-fixing solution can contain the aforesaid additives to be added to the bleaching solution and preservatives such as sulfites (e.g., sodium sulfite, potassium sulfite, ammonium sulfite, etc.), bisulfite, hydroxylamine, hydrazine, aldehyde-bisulfite adducts (e.g., acetaldehyde-sodium bisulfite adduct), etc. Further, various brightening agents, defoaming agents, surface active agents, polyvinyl pyrrolidone, organic solvents (e.g., methanol, etc.), etc., may be incorporated.

In a bleaching solution, a bleach-fixing solution or a prebath thereof, a bleach accelerator can be used, if desired.

After the fixing step or the bleach-fixing step, it is typical to carry out processing steps such as water washing, stabilization, etc.

In the water washing step or stabilizing step, various known compounds may be employed for the purpose of preventing the formation of precipitation or stabilizing washing water, if desired. Examples of such additives include a chelating agent such as an inorganic phosphoric acid, an aminopolycarboxylic acid, an organic phosphonic acid, etc., an antibacterial agent or an antifungal agent for preventing the propagation of various mold, bacteria, and algae (e.g., the compounds as described in *Journal of Antibacterial and Antifungal Agents*, Vol. 11, No. 5, pages 207 to 223 (1983) or the compounds as described in Hiroshi Horiguchi, *Boukin Boubai no Kagaku* (*Antibacterial and Antifungal Chemistry*), a metal salt represented by a magnesium salt, an aluminum salt, a bismuth salt, etc., an alkali metal or ammonium salt, or a surface active agent for reducing drying load or preventing drying mark, or the like. Further, the compounds as described in L. E. West, *Photo. Sci. and Eng.*, Vol. 6, pages 344 to 359 (1965) may be added thereto. It is particularly effective to add a chelating agent and an antibacterial or antifungal agent.

The water-washing step is ordinarily carried out by a multistage countercurrent water-washing process using two or more tanks (for example, using two to nine tanks) in order to save the amount of washing water used.

Further, in place of the water washing step, a multistage countercurrent stabilizing process as described in Japanese Patent Application (OPI) No. 8543/82 can be conducted. To the stabilizing bath, various kinds of compounds may be added for the purpose of stabilizing images formed in addition to the above-described additives. Representative examples of such compounds include various buffers (for example, borates, metaborates, borax, phosphates, carbonates, potassium hydroxide, sodium hydroxide, aqueous ammonia, monocarboxylic acids, dicarboxylic acids, polycarboxylic acids, etc., which can be used in combinations, also) in order to adjust pH of layers (for example, pH of 3 to 9), and aldehydes such as formalin, etc. In addition, various additives, for example, a chelating agent (e.g., an inorganic phosphonic acid, an aminopolycarboxylic acid, an organic phosphonic acid, an aminopolyphosphonic acid, a phosphonocarboxylic acid, etc.), an antibacterial agent, an antifungal agent (e.g., those of thiazole type, isothiazole type, halogenated phenol type, sulfanylamido type, benzotriazole type, etc.), a surface active agent, a brightening agent, a hardening agent, a metal salt, etc., may be employed. Two or more compounds for the same purpose or different purposes may be employed together.

Further, it is preferred to add various ammonium salts such as ammonium chloride, ammonium nitrate, ammonium sulfate, ammonium phosphate, ammonium sulfite, ammonium thiosulfate, etc., as pH adjusting agents for layers after development processing.

With respect to color light-sensitive materials for photographing, water-washing and stabilizing steps which are ordinarily carried out after fixing can be substituted with the above-described stabilizing step and water-washing step (water-saving process). In such a case, formalin in the stabilizing bath may be eliminated, when 2-equivalent magenta couplers are employed in the color light-sensitive materials.

The processing time for water-washing and stabilizing according to the present invention can be varied depending on kinds of color light-sensitive materials and processing conditions, but is usually from 20 seconds to 10 minutes, and preferably from 20 seconds to 5 minutes.

In the present invention, various kinds of processing solutions can be employed in a temperature range of from 10° C. to 50° C. Although a standard temperature is from 33° C. to 38° C., it is possible to carry out the processing at higher temperatures in order to accelerate the processing, whereby the processing time is shortened, or at lower temperatures in order to achieve improvement in image quality and to maintain stability of the processing solutions.

Further, for the purpose of saving the amount of silver employed in the color light-sensitive material, the photographic processing may be conducted utilizing color intensification using cobalt or hydrogen peroxide as described in West German Pat. No. 2,226,770 and U.S. Pat. No. 3,674,499, etc., or utilizing a combined developing and bleach fixing process as described in U.S. Pat. No. 3,923,511.

Moreover, the time of each processing step can be shortened compared to the standard processing time within a range which does not cause any problem, if desired, for the purpose of shortening the overall processing time.

For the purpose of simplification and acceleration of processing, a color developing agent or a precursor thereof may be incorporated into the color light-sensitive material used in the present invention. In order to incorporate the color developing agent, it is preferred to employ various precursors of color developing agents with a view of increasing stability of the color light-sensitive material. Suitable examples of the precursors of developing agents include indoaniline type compounds as described in U.S. Pat. No. 3,342,597, Schiff's base type compounds as described in U.S. Pat. No. 3,342,599 and *Research Disclosure,* RD No. 14850 (August, 1976), and ibid., RD No. 15159 (November, 1976), aldol compounds as described in *Research Disclosure,* RD No. 13924 (November, 1975), metal salt complexes as described in U.S. Pat. No. 3,719,492, urethane type compounds as described in Japanese Patent Application (OPI) No. 135628/78, and various salt type precursors as described in Japanese Patent Application (OPI) Nos. 6235/81, 16133/81, 59232/81, 67842/81, 83734/81, 83735/81, 83736/81, 89735/81, 81837/81, 54430/81, 106241/81, 107236/81, 97531/82, 83565/82, etc.

Further, the color light-sensitive material which can be used in the present invention may contain various 1-phenyl-3-pyrazolidones for the purpose of accelerating color development. Typical examples of the compounds are described in Japanese Patent Application (OPI) Nos. 64339/81, 144547/82, 211147/82, 50532/83, 50536/83, 50533/83, 50534/83, 50535/83, 115438/83, etc.

Moreover, in the case of continuous processing, the variation of composition in each processing solution can be prevented using a replenisher for the processing solution, whereby a constant finish can be achieved. The amount of replenisher can be reduced to one half or less of the standard amount of replenishment for the purpose of reducing cost.

In each of the processing baths, a heater, a temperature sensor, a liquid level sensor, a circulation pump, a filter, a floating cover, a squeezer, etc., may be provided, if desired.

A bleach-fixing process can be utilized very usually in the case wherein the color light-sensitive material of the present invention is a color paper, and, if desired, when it is a color light-sensitive material for photographing.

The present invention is explained in greater detail with reference to the following examples, but the present invention should not be construed as being limited thereto.

EXAMPLE 1

On a cellulose triacetate film support provided with a subbing layer were coated layers having the compositions shown below to prepare a multilayer color light-sensitive material which was designated as Sample 101.

Regarding the compositions of the layers, coated amounts of silver halide and colloidal silver are shown by a silver coated amount in a unit of g/m$^2$, those of couplers, additives and gelatin are shown using a unit of g/m$^2$, and those aof snsitizing dyes are shown using a molar amount per mol of silver halide present in the same layer.

| | |
|---|---|
| First Layer: Antihalation Layer | |
| Black colloidal silver | 0.4 |
| Gelatin | 1.3 |
| Colored Coupler C-1 | 0.06 |
| Ultraviolet Ray-Absorbing Agent UV-1 | 0.1 |
| Ultraviolet Ray-Absorbing Agent UV-2 | 0.2 |
| Dispersion oil, Oil-1 | 0.01 |
| Dispersion oil, Oil-2 | 0.01 |
| Second Layer: Interlayer | |
| Fine grain silver bromide (average particle size: 0.07 μm) | 0.15 |
| Gelatin | 1.0 |
| Colored Coupler C-2 | 0.02 |
| Dispersion oil, Oil-1 | 0.1 |
| Third Layer: First Red-Sensitive Emulsion Layer | |
| Silver iodobromide emulsion (silver iodide: 6 mol %, aspect ratio (diameter/thickness): 2.5, average particle size: 0.3 μm) | 1.5 |
| Gelatin | 0.6 |
| Sensitizing Dye I | $1 \times 10^{-4}$ |
| Sensitizing Dye II | $3 \times 10^{-4}$ |
| Sensitizing Dye III | $1 \times 10^{-5}$ |
| Coupler C-3 | 0.06 |
| Coupler C-4 | 0.06 |
| Coupler C-8 | 0.04 |
| Coupler C-2 | 0.03 |

-continued

| | |
|---|---|
| Dispersion oil, Oil-1 | 0.03 |
| Dispersion oil, Oil-3 | 0.012 |
| Fourth Layer: Second Red-Sensitive Emulsion Layer | |
| Silver iodobromide emulsion (silver iodide: 6 mol %, aspect ratio: 3.5, average particle size: 0.5 μm) | 1.5 |
| Gelatin | 1.0 |
| Sensitizing Dye I | $1 \times 10^{-4}$ |
| Sensitizing Dye II | $3 \times 10^{-4}$ |
| Sensitizing Dye III | $1 \times 10^{-5}$ |
| Coupler C-3 | 0.24 |
| Coupler C-4 | 0.24 |
| Coupler C-8 | 0.04 |
| Coupler C-2 | 0.04 |
| Dispersion oil, Oil-1 | 0.15 |
| Dispersion oil, Oil-3 | 0.02 |
| Fifth Layer: Third Red-Sensitive Emulsion Layer | |
| Silver iodobromide emulsion (silver iodide: 10 mol %, aspect ratio: 7.5, average diameter corresponding to project area: 4.0 μm) | 2.0 |
| Gelatin | 1.0 |
| Sensitizing Dye I | $2 \times 10^{-4}$ |
| Sensitizing Dye II | $6 \times 10^{-4}$ |
| Sensitizing Dye III | $2 \times 10^{-5}$ |
| Coupler C-6 | 0.05 |
| Coupler C-7 | 0.1 |
| Dispersion oil, Oil-1 | 0.01 |
| Dispersion oil, Oil-2 | 0.05 |
| Sixth Layer: Interlayer | |
| Gelatin | 1.0 |
| Compound Cpd-A | 0.03 |
| Dispersion oil, Oil-1 | 0.05 |
| Seventh Layer: First Green-Sensitive Emulsion Layer | |
| Silver iodobromide emulsion (silver iodide: 6 mol %, aspect ratio: 2.5, average particle size: 0.3 μm) | 0.7 |
| Sensitizing Dye IV | $5 \times 10^{-4}$ |
| Sensitizing Dye V | $2 \times 10^{-4}$ |
| Sensitizing Dye VI | $0.3 \times 10^{-4}$ |
| Gelatin | 1.0 |
| Coupler C-9 | 0.1 |
| Coupler C-5 | 0.03 |
| Coupler C-1 | 0.03 |
| Coupler C-16 | 0.7 |
| Dispersion oil, Oil-1 | 0.5 |
| Eighth Layer: Second Green-Sensitive Emulsion Layer | |
| Silver iodobromide emulsion (silver iodide: 5 mol %, aspect ratio: 3.5, average particle size: 0.5 μm) | 1.4 |
| Gelatin | 1.0 |
| Sensitizing Dye IV | $5 \times 10^{-4}$ |
| Sensitizing Dye V | $2 \times 10^{-4}$ |
| Sensitizing Dye VI | $0.3 \times 10^{-4}$ |
| Coupler C-9 | 0.25 |
| Coupler C-1 | 0.03 |
| Coupler C-10 | 0.015 |
| Coupler C-5 | 0.01 |
| Dispersion oil, Oil-1 | 0.2 |
| Ninth Layer: Third Green-Sensitive Emulsion Layer | |
| Silver iodobromide emulsion (silver iodide: 10 mol %, aspect ratio: 6.5, average diameter corresponding to project area: 3.5 μm) | 1.9 |
| Gelatin | 1.0 |
| Sensitizing Dye VII | $5.6 \times 10^{-4}$ |
| Sensitizing Dye VIII | $2.1 \times 10^{-4}$ |
| Coupler C-11 | 0.01 |
| Coupler C-12 | 0.03 |
| Coupler C-13 | 0.2 |
| Coupler C-1 | 0.02 |
| Coupler C-15 | 0.02 |
| Dispersion oil, Oil-1 | 0.20 |
| Dispersion oil, Oil-2 | 0.05 |

-continued

| | |
|---|---|
| Tenth Layer: Yellow Filter Layer | |
| Gelatin | 1.2 |
| Yellow colloidal silver | 0.16 |
| Compound Cpd-B | 0.1 |
| Dispersion oil, Oil-1 | 0.3 |
| Eleventh Layer: First Blue-Sensitive Emulsion Layer | |
| Monodispersed silver iodobromide emulsion (silver iodide: 6 mol %, aspect ratio: 15, average diameter corresponding to project area: 1.2 μm) | 1.0 |
| Gelatin | 1.0 |
| Sensitizing Dye IX | $6 \times 10^{-4}$ |
| Coupler C-14 | 0.45 |
| Coupler C-5 | 0.07 |
| Coupler C-17 | 0.8 |
| Dispersion oil, Oil-1 | 0.2 |
| Twelfth Layer: Second Blue-Sensitive Emulsion Layer | |
| Silver iodobromide emulsion (silver iodide: 10 mol %, aspect ratio: 20, average diameter corresponding to project area: 3.0 μm) | 0.9 |
| Gelatin | 0.6 |
| Sensitizing Dye IX | $3.5 \times 10^{-4}$ |
| Coupler C-14 | 0.25 |
| Dispersion oil, Oil-1 | 0.07 |
| Thirteenth Layer: First Protective Layer | |
| Gelatin | 0.8 |
| Ultraviolet Ray-Absorbing Agent VU-1 | 0.1 |
| Ultraviolet Ray-Absorbing Agent UV-2 | 0.2 |
| Dispersion oil, Oil-1 | 0.01 |
| Dispersion oil, Oil-2 | 0.01 |
| Fourteenth Layer: Second Protective Layer | |
| Fine grain silver bromide (average particle size: 0.07 μm) | 0.5 |
| Gelatin | 0.45 |
| Polymethyl methacrylate particle (diameter: 1.5 μm) | 0.2 |
| Hardening Agent H-1 | 0.4 |
| Formaldehyde Scavenger S-1 | 0.5 |
| Formaldehyde Scavenger S-2 | 0.5 |

A surface active agent was added to each of the layers as a coating said in addition to the above-described components.

The chemical structure formulae or chemical names of thde compounds employed for preparing the above-described sample are shown below.

UV-1

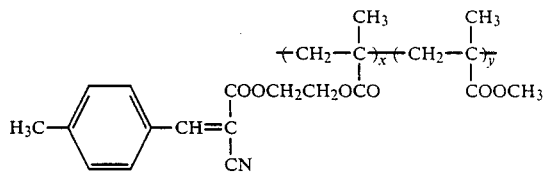

wherein x/y is 7/3 (weight ratio)

UV-2

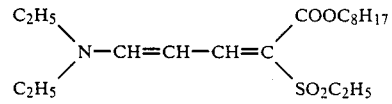

Oil-1: Tricresyl phosphate
Oil-2: Dibutyl phthalate
Oil-3: Bis (2-ethylhexyl) phthalate C-1
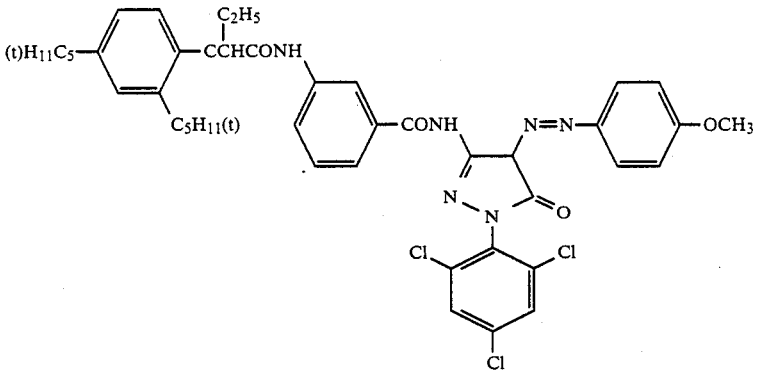
C-2
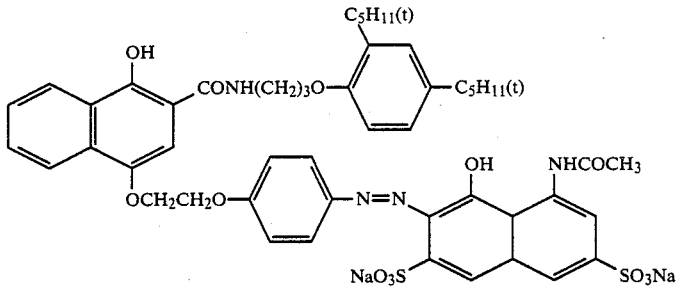
C-3
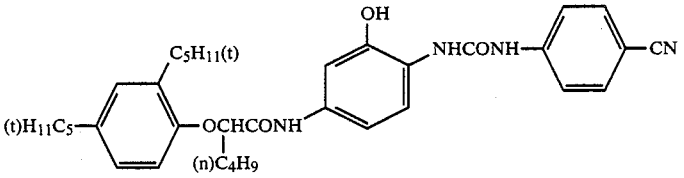
C-4
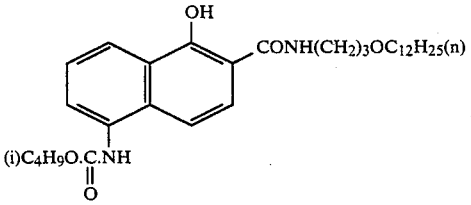
C-5
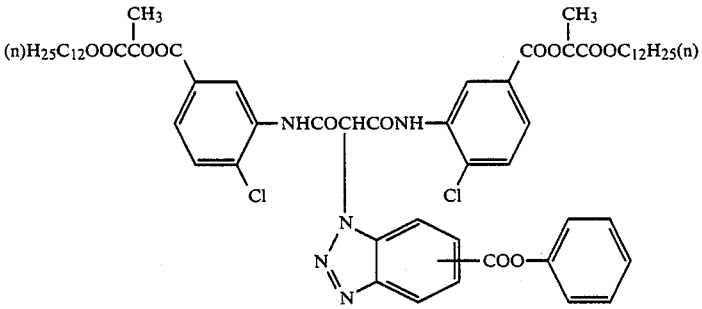

-continued
C-6
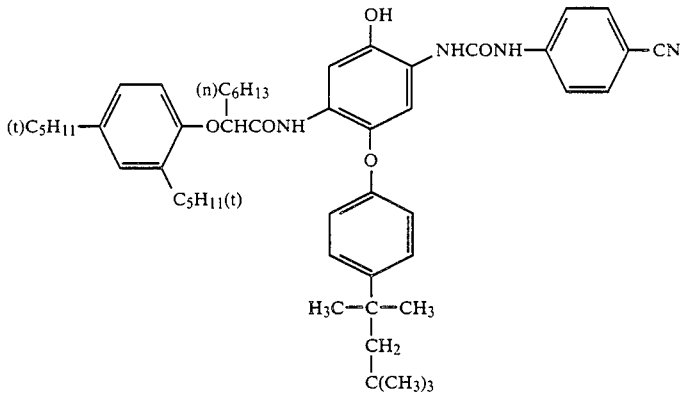
C-7
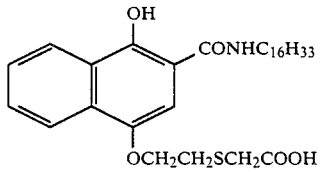
C-8
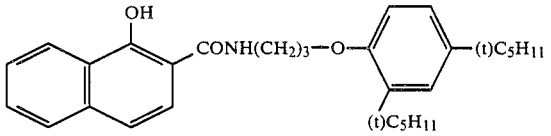
C-9
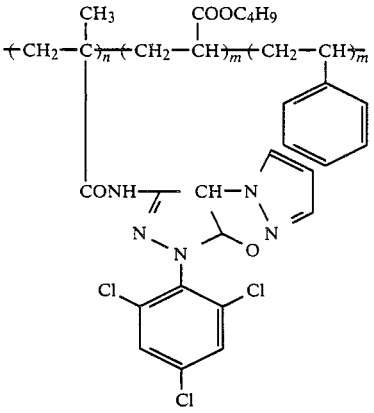
n = 50 m = 25 m' = 25
mol. wt.: about 20,000
C-10
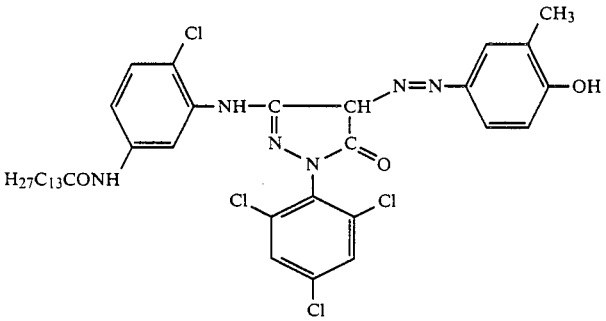

-continued
C-11
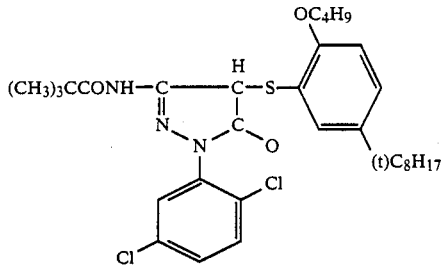
C-12
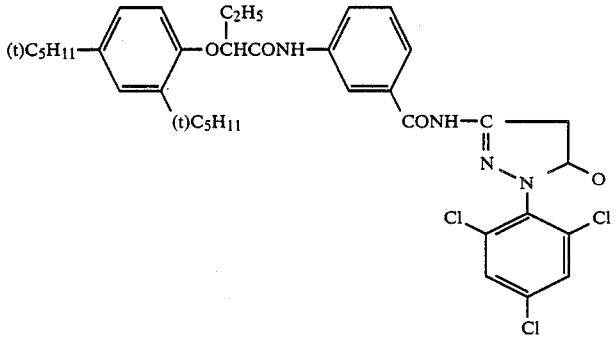
C-13
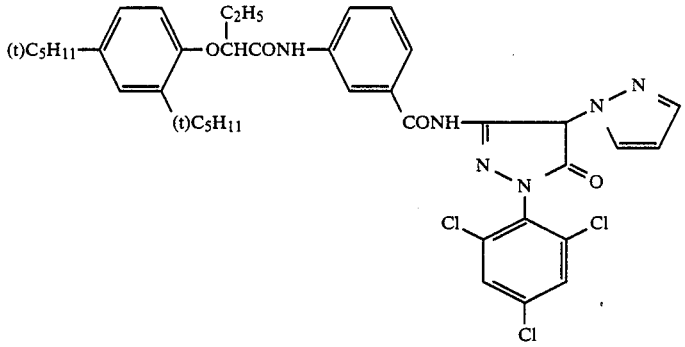
C-14
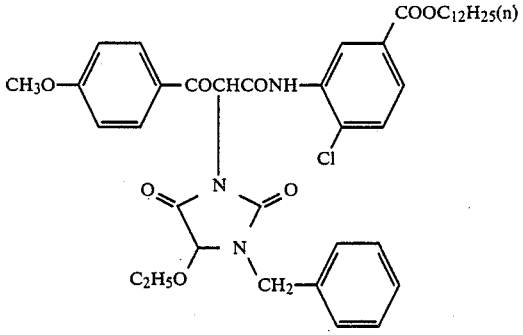
C-15
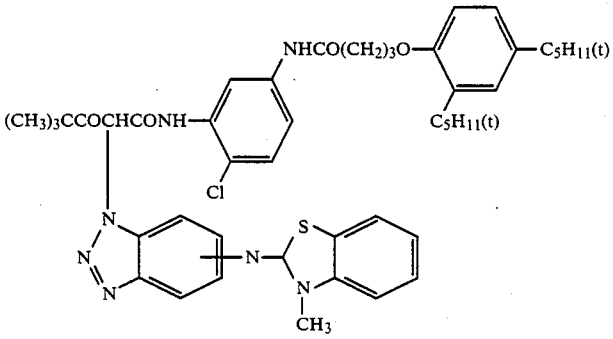

-continued
C-16
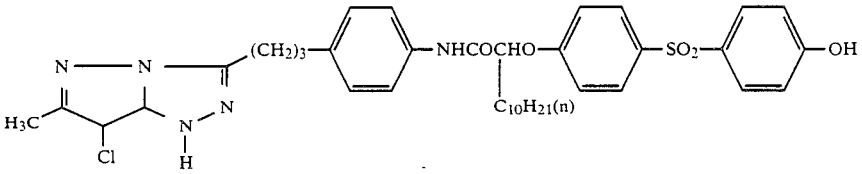
C-17
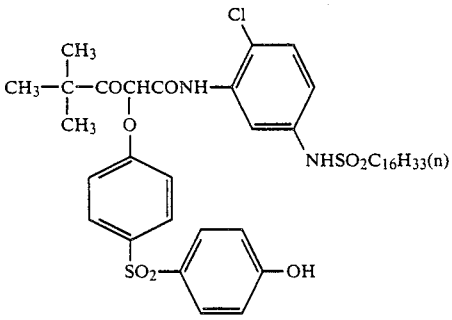
Sensitizing Dye I
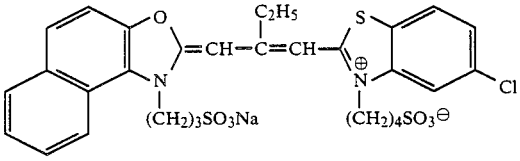
Sensitizing Dye II
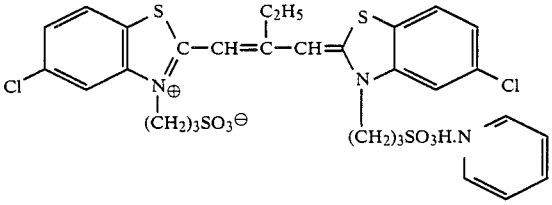
Sensitizing Dye III
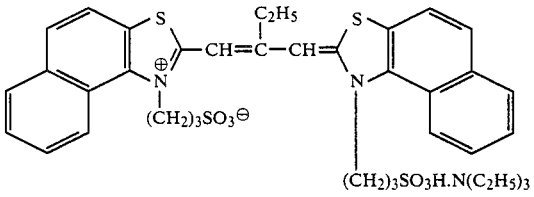
Sensitizing Dye IV
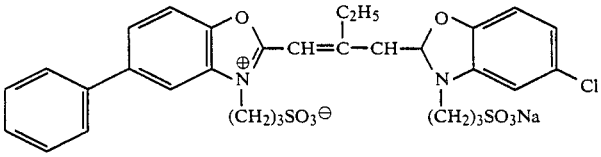
Sensitizing Dye V
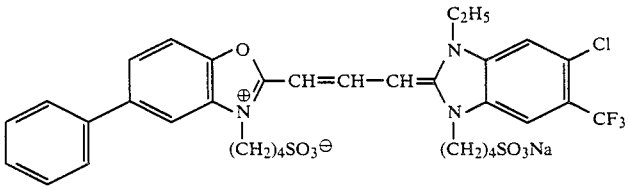

-continued

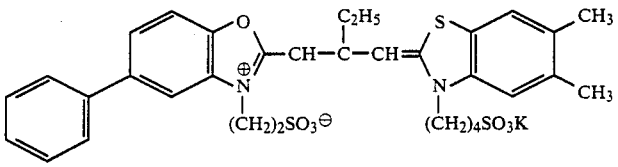

Sensitizing Dye VI

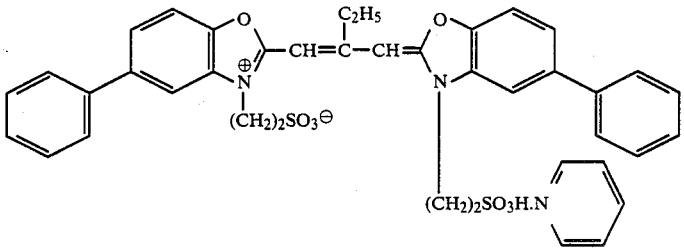

Sensitizing Dye VII

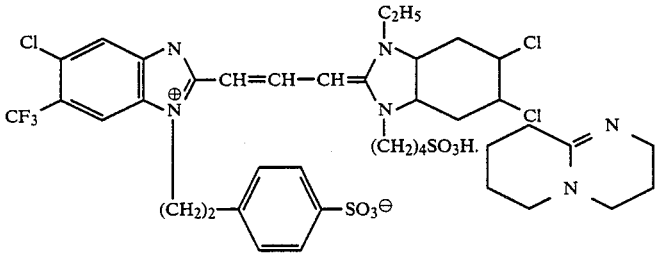

Sensitizing Dye VIII

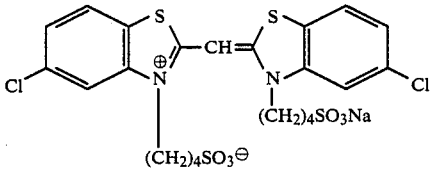

Sensitizing Dye IX

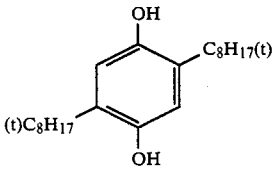

Cpd-A

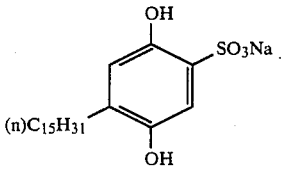

Cpd-B

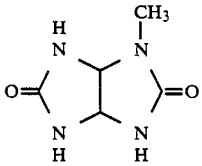

S-1

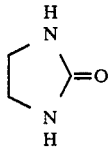

S-2

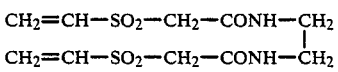

H-1

Samples 102 to 108 were preapred in the same manner as described for Sample 101 except adding the compounds shown in Table 1 in an amount of $2.5\times10^{-4}$ mol/m$^2$ to the first layer of the multilayer color light-sensitive material, i.e., Sample 101, respectively.

These samples were exposed to light in an exposure amount of 25 CMS using a tungsten light source and a filter to adjust the color temperature to 4,800° K., and then subjected to development processing at 38° C. according to the following processing steps.

| Processing Step | Processing Time |
|---|---|
| Color Development | 3 min 15 sec |
| Bleaching | 2 min 00 sec |
| Washing with Water | 2 min 10 sec |
| Fixing | 4 min 20 sec |
| Washing with Water | 3 min 15 sec |
| Stabilizing | 1 min 05 sec |

The processing solution used had the following compositions:

| | |
|---|---|
| Color Developing Solution: | |
| Diethylenetriaminepentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N—Ethyl-N—β-hydroxyethylamino)-2-methylaniline Sulfate | 4.5 g |
| Water to make | 1.0 liter |
| | pH 10.0 |
| Bleaching Solution: | |
| Iron (III) Ammonium Ethylenediamine-tetraacetate | 100.0 g |
| Disodium Ethylenediaminetetraacetate | 10.0 g |
| Ammonium Bromide | 150.0 g |
| Ammonium Nitrate | 10.0 g |
| Aqueous Ammonia (28 wt %) | 7.0 ml |
| Water to make | 1.0 liter |
| | pH 6.0 |
| Fixing Solution: | |
| Disodium Ethylenediaminetetraacetate | 1.0 g |
| Sodium Sulfite | 4.0 g |
| Ammonium Thiosulfate (70 wt % aq. soln.) | 175.0 ml |
| Sodium Bisulfite | 4.6 g |
| Water to make | 1.0 liter |
| | pH 6.6 |
| Stabilizing Solution: | |
| Formalin (40 wt % of formaldehyde solution) | 2.0 ml |
| Polyoxyethylene-p-monononylphenylether (average degree of polymerization: about 10) | 0.3 g |
| Water to make | 1.0 liter |

The silver amount remaining in each film sample having been subjected to the development processing as described above was measured according to X-ray fluorometric analysis. The results thus obtained are shown in Table 1 below.

Further, these samples were treated with the fixing solution described above at 38° C. for 30 minutes and then washed with water at 38° C. for 3 minutes, whereby all silver ions which had not been fixed and remained in the samples were removed. Then, the remaining amount of metal silver (developed silver) not bleached was measured in the same manner as described above. The results thus obtained are also shown in Table 1 below.

TABLE 1

| Sample No. | Bleach Accelerating Agent | Amount of Remaining Silver ($\mu g/cm^2$) | Amount of Silver Not Bleached ($\mu g/cm^2$) |
|---|---|---|---|
| 101 (Comparison) | None | 26.0 | 25.1 |
| 102 (Comparison) | Comparative Compound A | 14.6 | 4.2 |
| 103 (Comparison) | Comparative Compound B | 13.1 | 12.0 |
| 104 (Invention) | Compound (1) | 4.5 | 1.2 |
| 105 (Invention) | Compound (4) | 4.7 | 1.5 |
| 106 (Invention) | Compound (5) | 5.0 | 2.0 |
| 107 (Invention) | Compound (7) | 5.2 | 2.1 |
| 108 (Invention) | Compound (10) | 5.9 | 1.9 |

Comparative Compound A:

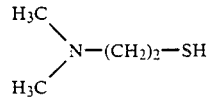

(This compound is described in U.S. Pat. No. 3,893,858.) Comparative Compound B:

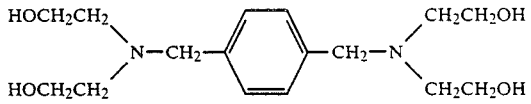

(This compound is described in U.S. Pat. No. 4,552,834.)

As is clear from the results shown in Table 1 above, with Comparative Compound A, although a fairly good bleach accelerating effect was obtained, the amount of remaining silver was large which means that fixing has been conducted insufficiently. On the other hand, with Comparative Compound B, while insufficient fixing was improved, the bleach accelerating effect was weak.

On the contrary, the compounds according to the present invention used in Samples 104 to 108 have the excellent desilver accelerating effect in that insufficient fixing was improved, and the bleach accelerating effect was extremely large. It can be understood that desirable photographic images having low amounts of remaining silver are obtained according to the present invention.

EXAMPLE 2

The same procedure as described in Example 1 was conducted using the same multilayer color light-sensitive materials as described in Example 1, except for employing the development processing shown below in place of the development processing used in Example 1. After the development processing, the amount of remaining silver and the amount of silver not bleached were measured. The results thus obtained are shown in Table 2 below.

| Processing Step | Time | Temperature |
|---|---|---|
| Color Development | 3 min 15 sec | 38° C. |
| Bleach-Fixing | 2 min 00 sec | " |
| Rinsing | 1 min 40 sec | " |
| Stabilizing | 40 sec | " |

The processing solutions used had the following compositions:

| | |
|---|---|
| Color Developing Solution: | |
| Diethylenetriaminepentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfite | 2.4 g |
| 4-(N—Ethyl-N—β-hydroxyethylamino)-2-methylaniline Sulfate | 4.5 g |
| Water to make | 1.0 liter |
| | pH 10.0 |
| Bleach-Fixing Solution: | |

-continued

| | |
|---|---|
| Iron (III) Ammonium Ethylenediamine-tetraacetate | 80.0 g |
| Disodium Ethylenediaminetetraacetate | 10.0 g |
| Sodium Sulfite | 12.0 g |
| Ammonium Thiosulfate (70 wt % aq. soln.) | 240 ml |
| Water to make | 1.0 liter |
| Adjusted pH to 6.8 with aqueous ammonia (28 wt %). | |
| Rinsing Solution: | |
| Disodium Ethylenediaminetetraacetate | 0.4 g |
| Water to make | 1.0 liter |
| Adjusted pH to 7.0 with sodium hydroxide. | |
| Stabilizing Solution: | |
| Formalin (37% w/v) | 2.0 ml |
| Polyoxyethylene-p-monononylether (average degree of polymerization: about 10) | 0.3 g |
| Water to make | 1.0 liter |

TABLE 2

| Sample No. | Bleach Accelerating Agent | Amount of Remaining Silver ($\mu g/cm^2$) | Amount of Silver Not Bleached ($\mu g/cm^2$) |
|---|---|---|---|
| 101 (Comparison) | None | 72.4 | 70.0 |
| 102 (Comparison) | Comparative Compound A | 29.3 | 4.6 |
| 103 (Comparison) | Comparative Compound B | 17.8 | 15.0 |
| 104 (Invention) | Compound (1) | 4.8 | 1.8 |
| 105 (Invention) | Compound (4) | 5.1 | 2.0 |
| 106 (Invention) | Compound (5) | 5.6 | 2.5 |
| 107 (Invention) | Compound (7) | 5.8 | 2.7 |
| 108 (Invention) | Compound (10) | 7.2 | 3.1 |

As is clear from the results shown in Table 2 above, the compounds according to the present invention show the extremely large desilver accelerating effect as compared with the comparative compounds in the case of a bleach-fixing treatment.

EXAMPLE 3

The same procedure as described in Example 1 was conducted except that each of the bleach accelerating agents was added to the sixth layer in an amount of $2.5\times10^{-4}$ mol/m$^2$ in place of the first layer. The compounds according to the present invention showed an excellent desilvering accelerating effect as compared with the same comparative compounds as illustrated in Example 1.

EXAMPLE 4

The same procedure as described in Example 2 was conducted except that each of the bleach accelerating agents was added to the twelfth layer in an amount of $2.5\times10^{-4}$ mol/m$^2$ in place of the first layer and that the same amount by weight of iron (III) ammonium diethylenetriaminepentaacetate was used in place of iron (III) ammonium ethylenediaminetetraacetate as the oxidizing agent in the bleach-fixing solution. The compounds according to the present invention showed an excellent desilvering accelerating effect as compared with the same comparative compounds as illustrated in Example 2.

EXAMPLE 5

The same procedure as escribed in Example 1 was conducted using the same multiplayer color light-sensitive materials as described in Example 1, except for empolying the development processing shown below in place of the development processing used in Example 1. After the development processing, the amount of remaining silver and the amount of silver not bleached were measured. The results thus obtained are shown in Table 3 below.

| Processing Step | Temperature (°C.) | Time |
|---|---|---|
| Color Development | 41 | 3 min |
| Stopping | 38 | 30 sec |
| Washing with Water | " | 30 sec |
| Prebath | " | 30 sec |
| Bleaching | " | 3 min |
| Washing with Water | " | 1 min |
| Fixing | " | 2 min |
| Washing with Water | " | 2 min |
| Stabilizing Bath | " | 10 sec |

The processing solution used had the following compositions:

| | |
|---|---|
| Color Developing Solution: | |
| Pentasodium Aminotri(methylene-phosphonate) | 1.5 g |
| Sodium Sulfite | 2.0 g |
| Sodium Bromide | 1.2 g |
| Sodium Carbonate | 26.0 g |
| N—Ethyl-N—β-methanesulfonamido-ethyl-3-methyl-4-aminoaniline Sesquisulfate Monohydrate | 4.0 g |
| Water to make | 1.0 liter |
| Adjusted pH to | 10.20 |
| Stopping Solution: | |
| Sulfuric Acid (7 N) | 50 ml |
| Water to make | 1.0 liter |
| Prebath: | |
| Sodium Metabisulfite | 10.0 g |
| Glacial Acetic Acid | 25.0 ml |
| Sodium Acetate | 10.0 g |
| Tetrasodium Ethylenediaminetetraacetate | 1.0 g |
| FBA-01* (a bleach accelerating agent manufactured by Fuji Photo Film Co., Ltd.) | 3.0 g |
| Water to make | 1.0 liter |
| Bleaching Solution: | |
| Gelatin | 0.5 g |
| Sodium Persulfate | 35.0 g |
| Sodium Chloride | 15.0 g |
| Sodium Primary Phosphate | 9.0 g |
| Phosphoric Acid (85 wt %) | 2.5 ml |
| Water to make | 1.0 liter |
| Fixing Solution: | |
| Pentasodium Aminotri(methylene-phosphonate) | 1.5 g |
| Ammonium Thiosulfate (58 wt %) | 185.0 ml |
| Sodium Sulfite | 10.0 g |
| Sodium Bisulfite | 8.4 g |
| Water to make | 1.0 liter |
| Stabilizing Solution: | |
| Formaldehyde (37 wt %) | 10.0 ml |

-continued

| Water to make | 1.0 liter |
|---|---|

*FBA-01:

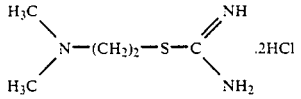

TABLE 3

| Sample No. | Bleach Accelerating Agent | Amount of Remaining Silver ($\mu g/cm^2$) | Amount of Silver Not Bleached ($\mu g/cm^2$) |
|---|---|---|---|
| 101 (Comparison) | None | 12.5 | 10.4 |
| 102 (Comparison) | Comparative Compound A | 11.4 | 4.7 |
| 103 (Comparison) | Comparative Compound B | 10.2 | 8.0 |
| 104 (Invention) | Compound (1) | 4.3 | 2.1 |
| 105 (Invention) | Compound (4) | 4.5 | 2.5 |
| 106 (Invention) | Compound (5) | 5.0 | 2.9 |
| 107 (Invention) | Compound (7) | 5.6 | 3.3 |
| 108 (Invention) | Compound (10) | 7.0 | 4.6 |

As is apparent from the results shown in Table 3 above, the compounds according to the present invention show an excellent desilvering accelerating effect as compared with the comparative compounds in the case of a bleaching solution of persulate type.

By the use of the color light-sensitive material according to the present invention, a rapid bleaching speed without late fixing can be achieved in the desilivering step and color phtographs having excellent image quality are obtained.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one photographic emulsion layer containing tabular silver halide grains having an average aspect ratio of 5 or more and the silver halide color photographic material containing at least one compound represented by formula (I)

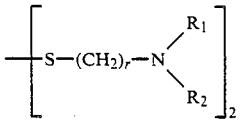

(I)

wherein $R_1$ and $R_2$ each represents a hydrogen atom, an alkyl group or an acyl group, provided that $R_1$ and $R_2$ do not both represent hydrogen atoms at the same time, or $R_1$ and $R_2$ together form a ring; and r represents an integer of from 1 to 3.

2. A silver halide color photographic material as claimed in claim 1, wherein the alkyl group represented by $R_1$ or $R_2$ is a substituted or unsubstituted lower alkyl group having from 1 to 5 carbon atoms.

3. A silver halide color photographic material as claimed in claim 2, wherein the alkyl group is a methyl group, an ethyl group or a propyl group.

4. A silver halide color photographic material as claimed in claim 1, wherein the acyl group represented by $R_1$ or $R_2$ has from 2 to 4 carbon atoms.

5. A silver halide color photographic material as claimed in claim 4, wherein the acyl group is an acetyl group or a propionyl group.

6. A silver halide color photographic material as claimed in claim 1, wherein a substituent for the group represented by $R_1$ or $R_2$ is selected from a hydroxyl group, a carboxyl group, a sulfo group, an alkylsulfonyl group and an amino group.

7. A silver halide color photographic material as claimed in claim 1, wherein the total amount of the compound represented by formula (I) added is in a range of from $1\times10^{-5}$ to $1\times10^{-2}$ mol/m$^2$.

8. A silver halide color photographic material as claimed in claim 1, wherein the tabular silver halide grains have an aspect ratio of from 5 to 8.

9. A silver halide color photographic material as claimed in claim 1, wherein the tabular silver halide grains have a diameter of from 0.3 to 5.0 $\mu$m.

10. A silver halide color photographic material as claimed in claim 1, wherein the tabular silver halide grains have a thickness of 0.4 $\mu$m or less.

11. A silver halide color photographic material as claimed in claim 9, wherein the tabular silver halide grains have a diameter of from 0.5 to 3.0 $\mu$m.

12. A silver halide color photographic material as claimed in claim 10, wherein the tabular silver halide grains have a thickness of 0.3 $\mu$m or less.

13. A silver halide color photographic material as claimed in claim 1, wherein the tabular silver halide grains are subjected to monodispersion in a tabular grain silver halide emulsion.

14. A silver halide color photographic material as claimed in claim 13, wherein in the tabular grain silver halide emulsion, at least 95% of the total silver halide grains have a size within the range of ±60% of the number-average grain size.

15. A silver halide color photographic material as claimed in claim 1, wherein the tabular silver halide grains occupy 50% or more based on the total project area of silver halide grains contained in the emulsion.

16. A silver halide color photographic material as claimed in claim 15, wherein the tabular silver halide grains occupy 70% or more based on the total project area of silver halide grains contained in the emulsion.

17. A silver halide color photographic material as claimed in claim 16, wherein the tabular silver halide grains occupy 90% or more based on the total project area of silver halide grains contained in the emulsion.

18. A silver halide color photographic material as claimed in claim 13, wherein in the tabular grain silver halide emulsion, at least 95% of the total silver halide grains have a size within the range of ±40% of the number-average grain size.

19. A silver halide color photographic material as claimed in claim 13, wherein in the tabular grain silver halide emulsion, at least 95% of the total silver halide grains have a size within the range of ±20% of the number-average grain size.

20. A silver halide color photographic material as claimed in claim 1, wherein the total amount of the compound represented by formula (1) added is in a range of from $2\times10^{-5}$ to $5\times10^{-3}$ mol/m$^2$.

21. A silver halide color photographic material as claimed in claim 1, wherein the total amount of the compound represented by formula (I) added is in a range of from $5\times10^{-5}$ to $2\times10^{-3}$.

22. A silver halide color photographic material as claimed in claim 20, wherein the tabular silver halide grains have an average aspect ratio of from 5 to 8.

23. A silver halide color photographic material as claimed in claim 21, wherein the tabular silver halide grains have an average aspect ratio of from 5 to 8.

* * * * *